US007537307B2

(12) United States Patent
Sugahara

(10) Patent No.: US 7,537,307 B2
(45) Date of Patent: May 26, 2009

(54) LIQUID-DROPLET JETTING APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 345 days.

(21) Appl. No.: 11/420,843

(22) Filed: May 30, 2006

(65) Prior Publication Data

US 2006/0268054 A1 Nov. 30, 2006

(30) Foreign Application Priority Data

May 30, 2005 (JP) ..... 2005-156724

(51) Int. Cl.
*B41J 2/165* (2006.01)
*B41J 2/145* (2006.01)

(52) U.S. Cl. ..... 347/29; 347/30; 347/32; 347/41

(58) Field of Classification Search ..... 347/22–24, 347/28–30, 32, 41–43, 47, 85, 86
See application file for complete search history.

(56) References Cited

FOREIGN PATENT DOCUMENTS

| | | | |
|---|---|---|---|
| JP | 178451 | | 7/1989 |
| JP | 81156 | | 4/1991 |
| JP | 03081156 | * | 4/1991 |
| JP | 220970 | | 8/1993 |

* cited by examiner

*Primary Examiner*—Shih-Wen Hsieh
(74) *Attorney, Agent, or Firm*—Baker Botts L.L.P.

(57) ABSTRACT

An ink-jet printer as a liquid-droplet jetting apparatus includes an ink-jet head which includes a channel unit having a plurality of recovery nozzles formed in the vicinity of a plurality of jetting nozzles, respectively; and a recovery channel communicating with the recovery nozzles, a suction pump and a cap. Recovery ports, which are openings of the recovery nozzles, are formed to be adjacent to opening ports which are openings of the jetting nozzles. The suction pump of the ink-jet head is activated in a state that a cap covers both of the jetting and recovery ports, so as to recovery the ink jetted from the jetting ports through the recovery ports. Accordingly, there is provided a liquid-droplet jetting apparatus capable of preventing, as much as possible, the ink jetted through the jetting nozzles during purge operation from adhering to a portion in the vicinity of the jetting ports.

15 Claims, 17 Drawing Sheets

LIQUID-DROPLET JETTING APPARATUS

CROSS REFERENCE TO RELATED APPLICATION

The present application claims priority from Japanese Patent Application No. 2005-156724, filed on May 30, 2005, the disclosure of which is incorporated herein by reference in its entirety.

BACKGROUND OF THE INVENTION

1. Field of the Invention

The present invention relates to a liquid-droplet jetting apparatus which jets liquid from a nozzle.

2. Description of Related Art

An ink-jet head is an apparatus which jets liquid droplets of ink from nozzles onto an object such as recording paper. In the ink-jet head, however, when the nozzles are clogged due to dust and/or the ink with increased viscosity or when any air bubbles enter in an ink channel including the nozzles, the jetting characteristics of the nozzles (such as a volume of jetted liquid-droplets and a flying direction of liquid droplets) become abnormal in some case, and further, the ink cannot be jetted from the nozzles at all in other cases. For this reason, when the ink cannot be jetted from the nozzles normally, an ink-jet head of general type has a construction for performing an operation (so-called purge operation) to forcibly jet the ink from the nozzles to discharge (purge) the dust and/or air bubbles, thereby resolving the abnormality in the ink-jetting operation.

For example, Japanese Patent Application Laid-open No. 05-220970 describes an ink-jet head (printing head) including a cap (capping member) which can be attached to an ink-jetting surface so as to cover jetting ports of nozzles, and a suction pump connected to the cap via a tube. In a state that the cap is attached to the ink-jetting surface, the suction pump sucks the ink from the nozzles to forcibly jet the ink into a space within the cap, thereby making it possible to resolve the abnormal state in the ink-jetting head.

During the purge operation, however, a part or portion of the ink, which flows out of the nozzles and is in a bubbled state, is easily adhered to a portion in the vicinity of jetting ports in the ink-jetting surface. Further, since the inside of the ink-jet head is maintained at negative pressure, there is a fear that the bubbled ink returns to the inside of nozzles and any bubbles enter in the nozzles, thereby again causing the abnormal state in which the ink cannot be jetted in a normal manner from the nozzles. In addition, in order to recover the ink sucked by a suction pump or the like during a purge operation to reuse (recycle) the ink, a complex structure such as a tube connecting the cap and a sub tank for the ink provided in a movable ink-jet head is needed. Therefore, the sucked ink has been wasted (discarded) in a wasted ink chamber without being reused An object of the present invention is to provide a liquid-droplet jetting apparatus which is capable of preventing, as much as possible, the ink flowing out of the jetting nozzles during purge operation from adhering to a portion in the vicinity of the jetting ports of the jetting nozzles.

According to a first aspect of the present invention, there is provided a liquid-droplet jetting apparatus which jets a liquid in a liquid-droplet state, the liquid-droplet jetting apparatus including:

a channel unit including a jetting nozzle, a jetting channel communicating with the jetting nozzle, a recovery nozzle, a recovery channel communicating with the recovery nozzle, and a liquid-droplet jetting surface in which a jetting port and a recovery port are formed as an opening of the jetting nozzle and an opening of the recovery nozzle, respectively;

a jetting-pressure applying mechanism which applies jetting pressure to the liquid in the jetting channel;

a cap which detachably covers both of the jetting port of the jetting nozzle and the recovery port of the recovery nozzle; and a purge pressure applying mechanism which causes the liquid in the jetting channel to flow to the recovery channel when the cap covers both of the jetting port and the recovery port;

wherein the liquid is flowed out from the jetting port to be recovered from the recovery port to the recovery channel by the purge pressure applying mechanism. Further, the recovery port of the recovery nozzle may be formed, in the liquid-droplet jetting surface, adjacent to the jetting port of the jetting nozzle.

According to the first aspect of the present invention, when a jetting pressure is applied to the liquid in the jetting channel by the jetting-pressure applying mechanism, the liquid is jetted from the jetting nozzle communicating with the jetting channel. On the other hand, when the jetting of the liquid from the jetting nozzle become abnormal due to the clog-up of the jetting nozzle and/or air bubble entered in the jetting channel, or the like, the liquid in the jetting channel is flowed out from the jetting nozzle, for example, to the space between the cap and the liquid-droplet jetting surface by the purge pressure applying means, in a state that the cap covers the jetting port of the jetting nozzle.

Here, for example, the recovery nozzle is formed at a portion in the vicinity of the jetting nozzle, and the recovery port of the recovery nozzle may be provided adjacent to the jetting port of the jetting nozzle. Furthermore, when the jetting nozzle is purged, the jetting port of the jetting nozzle and the recovery port of the recovery nozzle are sealed and covered by one cap. Accordingly, the liquid flowed out of the jetting nozzle can be recovered from the space between the cap and the liquid-droplet jetting surface, via the recovery nozzle to the recovery channel. Therefore, a substantial part of the liquid bubbled when being flowed out from the jetting nozzle is recovered and hardly adheres to the liquid-droplet jetting surface, and thus an amount of the liquid, adhered to a portion in the vicinity of the jetting nozzle in the liquid-droplet jetting surface, becomes small. Accordingly, it is possible to prevent, as much as possible, the liquid, which is bubbled when being flowed out of the jetting nozzle, from returning to the inside of the jetting nozzle and causing any jetting abnormality of the nozzle.

In the liquid-droplet jetting apparatus of the present invention, the purge pressure applying mechanism may include a suction unit which performs sucking from a side of the recovery channel to depressurize a space formed between the cap and the liquid-droplet jetting surface. Accordingly, by depressurizing the space between the cap and the liquid-droplet jetting surface by the sucking unit, it is possible to perform purge for the jetting nozzle by making the liquid flow out from the jetting port of the jetting nozzle to the space between the cap and the liquid-droplet jetting surface, and to recover the flowed-out liquid from the recovery nozzle to the recovery channel.

In the liquid-droplet jetting apparatus of the present invention, the purge pressure applying mechanism may further include a pressurizing unit which pressurizes the liquid in the jetting channel. According to this construction, during the purge for the jetting nozzle, it is possible to increase a speed at which the liquid is flowed out by pressurizing the liquid in the jetting channel with the pressurizing unit, thereby performing the purging assuredly.

In the liquid-droplet jetting apparatus of the present invention, the recovery nozzle may include a plurality of individual recovery nozzles, the individual nozzles having individual recovery ports respectively, the individual recovery ports being openings of the individual recovery ports; and two individual recovery ports included in the individual recovery ports may be arranged in the liquid-droplet jetting surface at positions opposite to each other with respect to the jetting port. According to this construction, since the liquid flowed out of the jetting port of the jetting nozzle is recovered assuredly by the individual recovery ports, of the individual recovery nozzles, arranged on both sides respectively of the jetting port, it is possible to further reduce an amount of the liquid adhered to a portion in the vicinity of the jetting port.

In the liquid-droplet jetting apparatus of the present invention, the jetting nozzle of the channel unit may include a plurality of individual jetting nozzles; the recovery nozzle of the channel unit may include a plurality of individual recovery nozzles; and individual jetting ports which are openings of the individual jetting nozzles and individual recovery ports which are openings of the individual recovery nozzles may be formed in the liquid-droplet jetting surface. By forming the plurality of individual jetting nozzles and the plurality of individual recovery nozzles in the channel unit, it is possible to jet and recover the liquid in a substantial amount at a time.

In the liquid-droplet jetting apparatus of the present invention, the individual jetting ports may be aligned in a predetermined direction in the liquid-droplet jetting surface; and each of the individual recovery ports may be arranged between the individual jetting ports. According to this construction, the liquid flowed out from two individual jetting ports can be recovered from an individual recovery port arranged between these two individual jetting ports, thereby reducing the number of individual recovery ports. In addition, it is possible to arrange the individual recovery ports densely, thereby leading to miniaturization of the apparatus.

In the liquid-droplet jetting apparatus of the present invention, the individual jetting ports may be aligned in a row in a predetermined direction in the liquid-droplet jetting surface; and the individual recovery ports may be aligned in rows parallel to a direction in which the individual jetting ports are aligned, the rows of the individual recovery ports being at both sides the row of the individual jetting ports. According to this construction, the liquid flowed out from the individual jetting ports can be recovered assuredly from the individual recovery ports aligned at both sides of the individual jetting ports, and amount of the liquid adhered to portions in the vicinity of the individual jetting ports can be reduced.

In the liquid-droplet jetting apparatus of the present invention, the individual jetting ports may be aligned in a plurality of rows along a predetermined direction and at a predetermined pitch in the liquid-droplet jetting surface;

an individual jetting port, belonging to one of two adjacent rows included in the rows of the individual jetting ports, may be arranged in the predetermined direction to be shifted by a half of the pitch relative to another individual jetting port belonging to the other of the two adjacent rows of the individual jetting ports;

the individual recovery ports may be aligned, between the two adjacent rows of the individual jetting ports, along the predetermined direction and at the predetermined pitch; and each of the individual recovery ports may be positioned on a line connecting two individual jetting ports belonging to the two rows of the individual jetting ports, respectively, and which are arranged in the predetermined direction to be shifted from each other by the half of the pitch, the two rows of the individual jetting ports being aligned on both sides, respectively, of the individual recovery ports. According to this construction, during the purge operation, the liquid flowed out from the individual jetting nozzles can be recovered effectively with the individual recovery nozzles which number is half of that of the individual jetting nozzles. Therefore, it is possible to secure a wide area at which the individual jetting nozzles are arranged, thereby arranging the individual jetting nozzles highly densely to miniaturize the liquid-droplet jetting apparatus.

The liquid-droplet jetting apparatus of the present invention may have a communication section which communicates the jetting channel and the recovery channel in an outside of the channel unit. According to this construction, the liquid flowed out from the jetting nozzle during the purge operation can be recovered from the recovery nozzle, and then the liquid can be returned to the jetting channel via the communication section, thereby making it possible to reuse (recycle) the liquid.

In the liquid-droplet jetting apparatus of the present invention, the communication section may be provided with a filter which removes a foreign substance existing in the liquid recovered from the recovery channel. According to this construction, any foreign substance existing in the recovered liquid can be removed by the filter before the recovered liquid is returned to the jetting channel. Therefore, it is possible to prevent the foreign matter from flowing into the jetting channel and to cause the clog-up of the jetting nozzle.

In the liquid-droplet jetting apparatus of the present invention, the communication section may have a storage portion which stores the liquid recovered from the recovery channel; and the filter may be provided in the storage portion. According to this construction, the liquid, flowed from the recovery channel to the storage portion, passes through the filter in the storage portion so that the foreign substance is removed from the liquid, and then the liquid flows into the jetting channel. Therefore, it is possible to prevent the foreign substance from flowing into the jetting channel and to cause the clog-up of the jetting nozzle.

In the liquid-droplet jetting apparatus of the present invention, the liquid recovered from the recovery channel may be jetted from the jetting nozzle via the jetting channel. In this case, the liquid, which has been recovered from the recovery channel can be circulated to be jetted again, an amount of the discarded liquid can be reduced. For example, when the liquid-droplet jetting apparatus is an ink-jet printer, the amount of ink, discarded during the purge operation of the head, can be drastically reduced. Accordingly, there is no need to provide in the inside of the printer a discarded liquid chamber to which the ink is discarded. In addition, since there is no need to estimate an amount of ink to be discarded during purge operation in advance, it is possible to reduce an amount of the ink, which is substantially necessary for performing printing onto a predetermined number of paper sheets or the like. Thus, a volume of the ink tank can be miniaturized.

In the liquid-droplet jetting apparatus of the present invention, liquid repellence of an area around the jetting port may be greater than that of an area around the recovery port in the liquid-droplet jetting surface. In this case, an amount of the liquid adhered to a portion around the jetting port can be reduced, thereby effectively recover the liquid adhered to a portion around the recovery port.

In the liquid-droplet jetting apparatus of the present invention, the cap may be partitioned into a plurality of areas, and each of the areas of the cap may independently cover the individual jetting ports and the individual recovery ports. In this case, it is possible to effectively recover the liquid by partitioning the cap into a plurality of areas in accordance with the arrangement of the individual jetting ports and individual recovery ports.

According to a second aspect of the present invention, there is provided a liquid-droplet jetting apparatus which jets a liquid in a liquid-droplet state, the liquid-droplet apparatus including:

a head including: a channel unit having a jetting nozzle, and a jetting channel communicating with the jetting nozzle; a maintenance mechanism which has a recovery nozzle and a recovery channel communicating with the recovery channel and which perform maintenance for the channel unit; and a liquid-droplet jetting surface formed with a jetting port and a recovery port as an opening of the jetting nozzle and an opening of the recovery nozzle, respectively;

a jetting pressure applying mechanism which applies jetting pressure to the liquid in the jetting channel;

a cap which detachably covers both of the jetting port of the jetting nozzle and the recovery port of the recovery nozzle; and a purge-pressure applying mechanism which is fluidly connected to the recovery channel and which applies purge pressure to the liquid in the recovery channel;

wherein the liquid is flowed out from the jetting port to be recovered from the recovery port to the recovery channel by the purge pressure applying mechanism.

According to the second aspect of the present invention, the maintenance mechanism is provided to the head, and the cap and the maintenance mechanism are not integrally formed. Therefore, it is possible to miniaturize the area in which the cap of the liquid-droplet apparatus is arranged, thereby reducing a space for installing the liquid-droplet jetting apparatus.

In the present application, the term "purge pressure" means a pressure applied to the liquid or the like in the recovery channel so as to recover the liquid via the recovery channel, and is intended to include both negative pressure and positive pressure.

DETAILED DESCRIPTION OF THE PREFERRED EMBODIMENTS

An embodiment of the present invention will be explained below. This embodiment is an example in which the present invention is applied to an ink-jet printer, as a liquid-droplet jetting apparatus, which jets ink from nozzles onto a recording paper to record an image or the like onto the recording paper.

Figure 1:
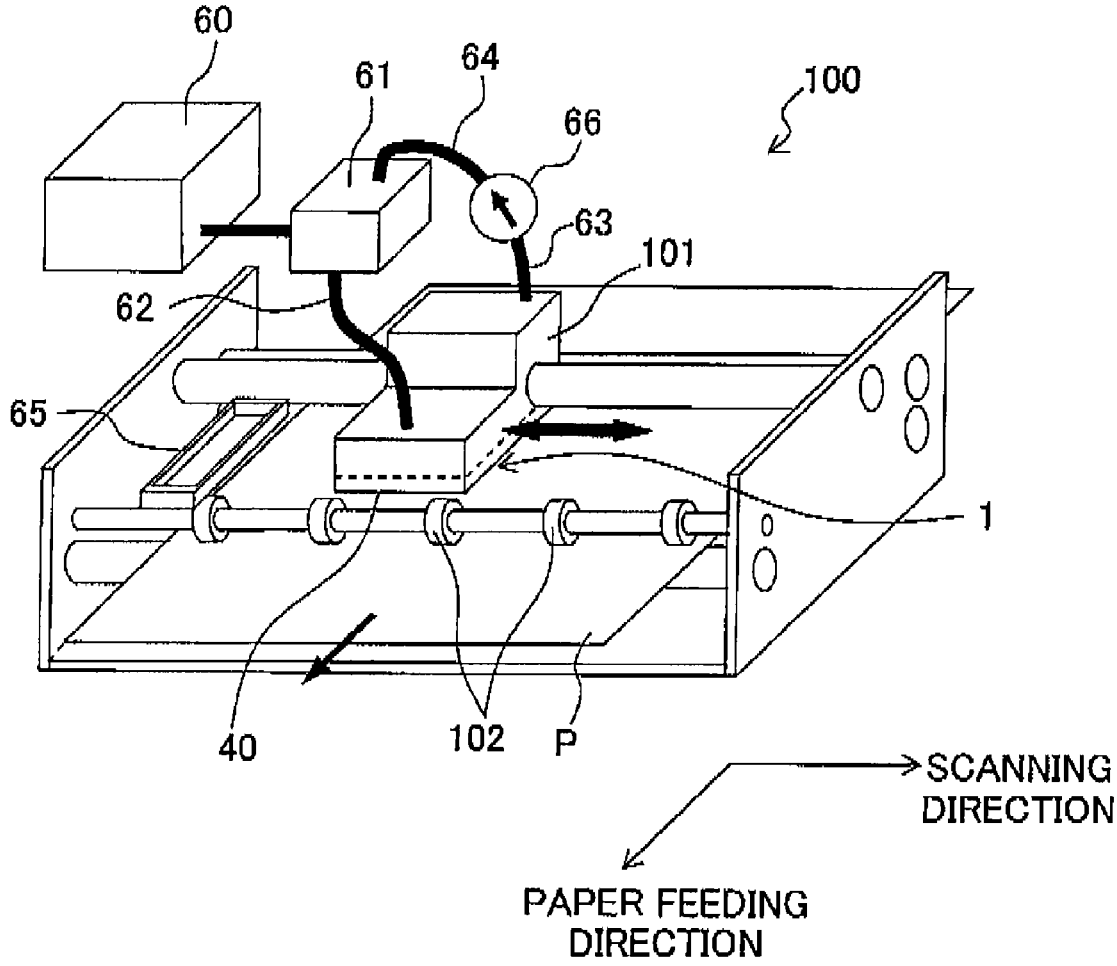
FIG. 1 is a schematic view showing a structure of an ink-jet printer according to an embodiment of the present invention.

As shown in FIG. 1, an ink-jet printer 100 includes a carriage 101 which is movable in a scanning direction (left and right direction in FIG. 1); an ink-jet head 1 of serial type which is provided to the carriage 101 and which jets an ink onto a recording paper P; transporting rollers 102 which transport (feed) the recording paper P in a paper feeding direction (forward) in FIG. 1, and the like. The ink is supplied to the ink-jet head 1 through a tube 62 from a sub tank 61 which is connected to an ink tank 60. Further, the ink-jet head 1 is constructed such that while the ink-jet head 1 moves integrally with the carriage 101 in the scanning direction, the ink-jet head 1 jets the ink onto the recording paper P from jetting ports 20*a* of jetting nozzles 20 (see FIG. 4) which are formed in an ink-jetting surface 40 (liquid-droplet jetting surface) of the lower surface of the ink-jet head 1. The recording paper P, with a character and/or an image recorded thereon by the ink-jet head 1, is discharged by the transporting rollers 102 in the paper feeding direction.

In addition, the ink-jet printer 100 includes a cap 65 which is capable of making contact with the ink-jetting surface 40 so as to cover the jetting ports 20*a* of the jetting nozzles 20, and a suction pump 66 (suction unit, purge pressure applying mechanism) which sucks the ink from the jetting nozzles 20 in a state that the cap 65 makes contact with the ink-jetting surface 40. When it is not possible to make the ink to be jetted from the jetting nozzles 20 in a normal manner due to the clog-up of the jetting nozzles 20 with any foreign substance such as dust and/or the entrance of air bubbles into the ink channel of the ink-jet head 1, the ink-jet printer 100 activates the suction pump 65 in a state that the cap 65 is made to have a contact with the ink-jetting surface 40, so as to perform a purging operation in which the ink is forcibly jetted from the jetting nozzles 20.

Next, the ink-jet head 1 will be explained in detail with reference to FIGS. 2 to 7. As shown in FIGS. 2 to 7, the ink-jet head 1 is provided with a channel unit 2 in which individual ink channels 21 (see FIG. 6) each including a pressure chamber 14 are formed, and a piezoelectric actuator 3 (jetting pressure applying mechanism) arranged on the upper surface of the channel unit 2.

First, the channel unit 2 will be explained. As shown in FIGS. 3 and 5 to 7, the channel unit 2 includes a cavity plate 10, a base plate 11, a manifold plate 12 and a nozzle plate 13, and these four plates are joined together in stacked layers. Among these plates, the cavity plate 10, base plate 11 and manifold plate 12 are stainless steel plates. A manifold 17 and pressure chambers 14, which will be explained later on, can be easily formed by etching or the like in these three plates 10 to 12. The nozzle plate 13 is formed of a high-molecular synthetic resin material such as polyimide, and is joined to the lower surface of the manifold plate 12. Alternatively, this nozzle plate 13 may be formed of a metallic material such as stainless steel similar to the three plates 10 to 12.

As shown in FIGS. 2, 3 and 5 to 7, a plurality of pressure chambers 14 (for example, 10 pieces of pressure chambers 14) arranged along a plane are formed in the cavity plate 10, and these pressure chambers 14 are open upwardly. The pressure chambers 14 are aligned in two rows in the paper feeding direction (up and down direction in FIG. 2). Each of the pressure chambers 14 is formed to have a substantially ecliptic shape which is long in the scanning direction (left and right direction in FIG. 2) in a plan view, Communication holes 15, 16 are formed in the base plate 11 at positions overlapping in a plan view with both end portions, respectively, of each of the pressure chambers 14. In addition, a manifold 17 is formed in the manifold plate 12. The manifold 17 extends in the paper feeding direction (up and down direction in FIG. 2) and is arranged so as to overlap in a plan view with left halves of the pressure chambers 14 aligned in the left side and with right halves of the pressure chambers 14 aligned in the right side. Further, the manifold 17 is communicated with an ink supply port 18 formed in a vibration plate 30 which will be explained later, and ink is supplied to the manifold 17 from the sub tank 61 (see FIG. 1) via a tube 62 and the ink supply hole 18. A plurality of communication holes 19 are formed in the manifold plate 12 at positions each of which overlaps in a plan view with an end portion of one of the pressure chambers 14, the end portion being on a side of the pressure chamber 14 opposite to the manifold 17.

Figure 2:
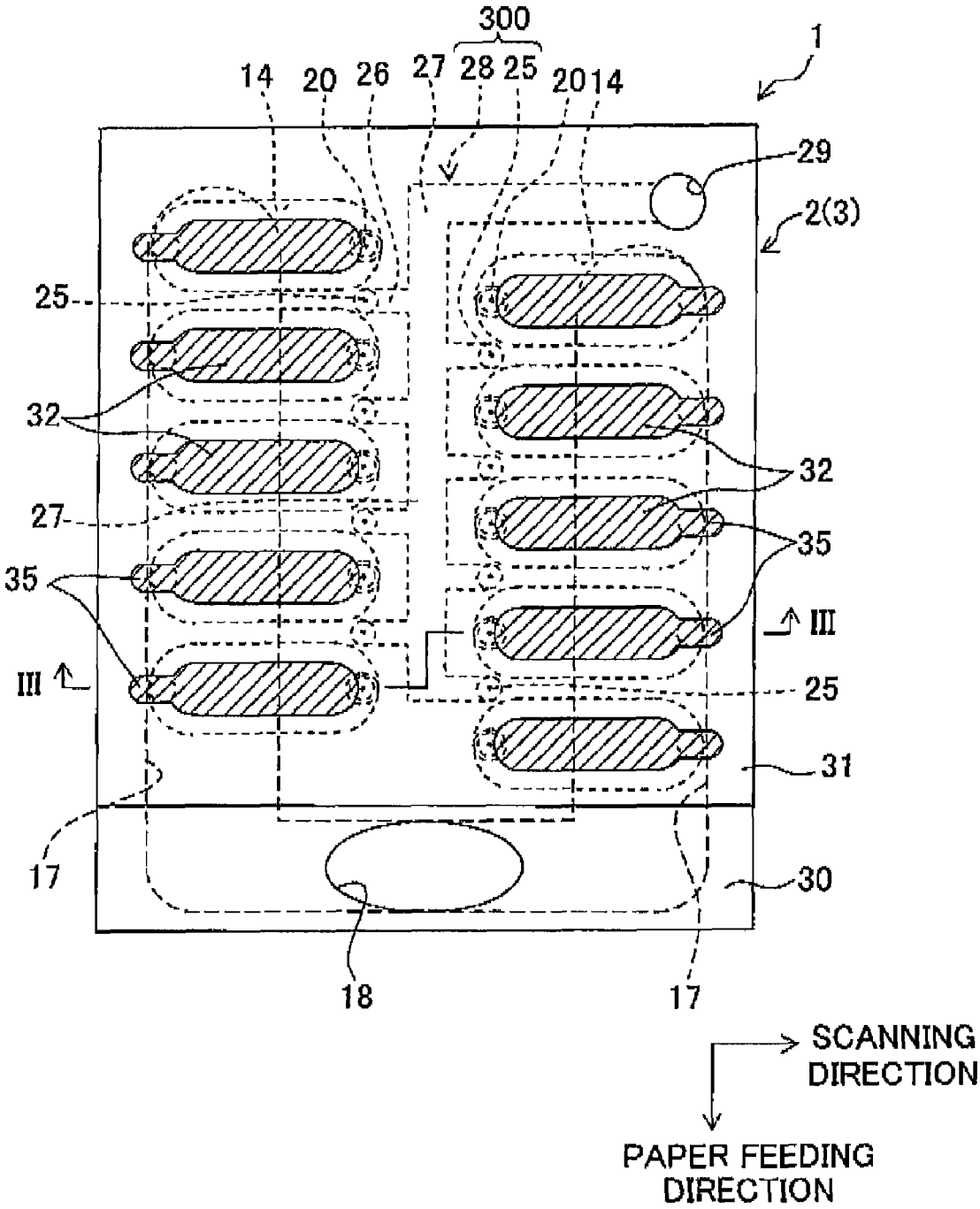
FIG. 2 is a plan view of an ink-jet head.
Figure 4:
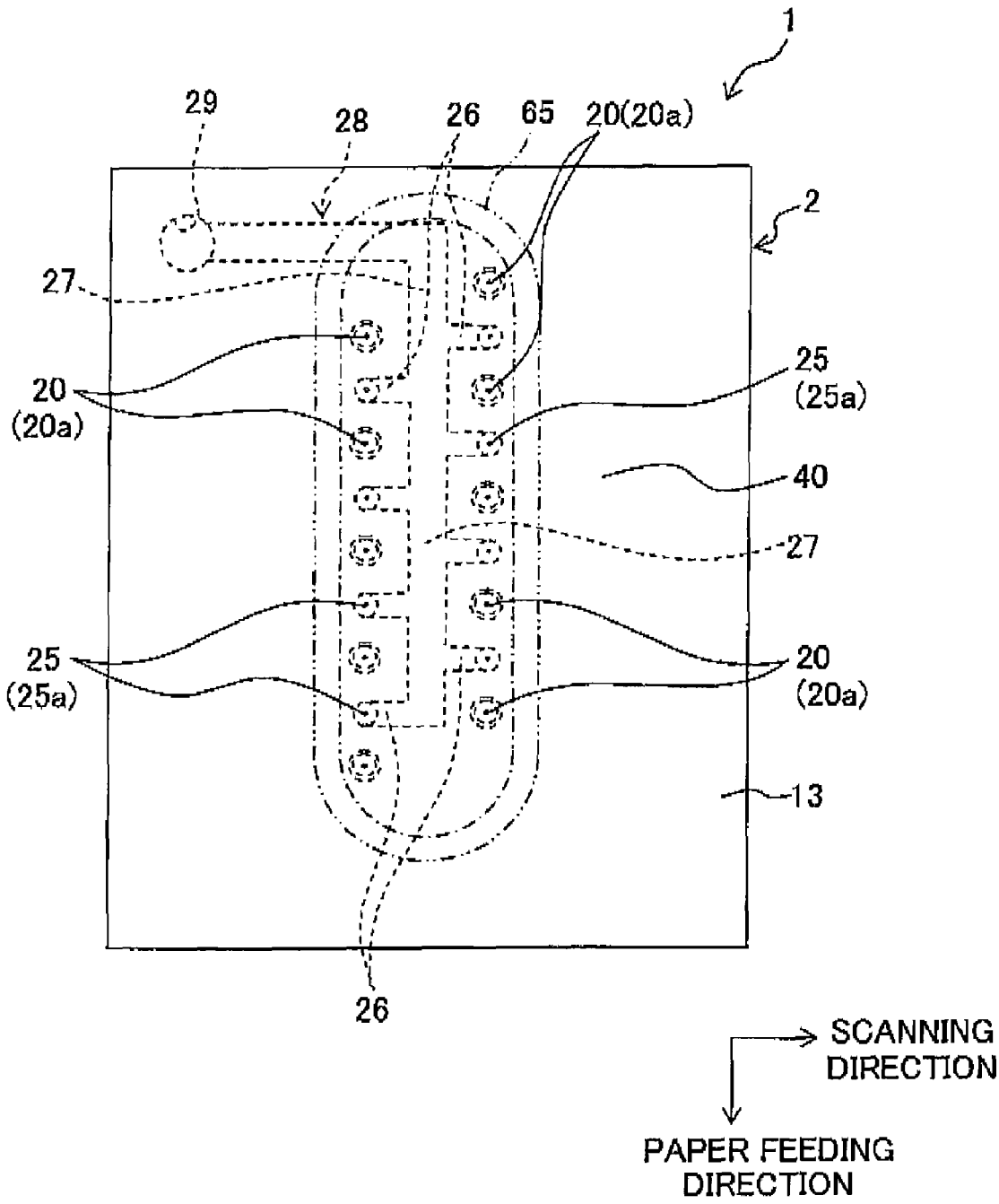
FIG. 4 is a bottom view of the ink-jet head.
Figure 5:
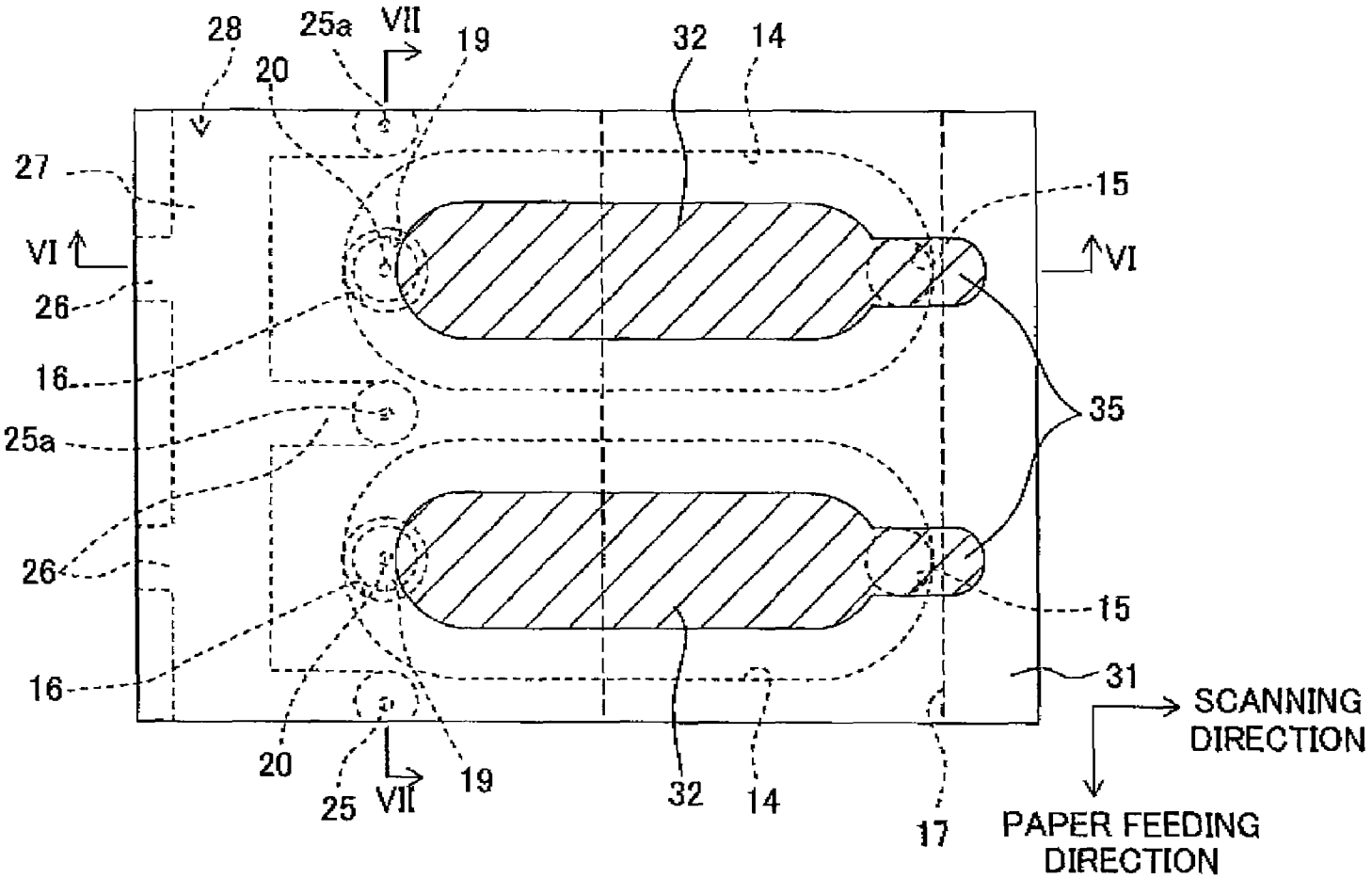
FIG. 5 is a partially enlarged view of FIG. 2.

Furthermore, a plurality of jetting nozzles (individual jetting nozzles) 20 are formed in the nozzle plate 13 at positions each of which overlaps in a plan view with one of the communication holes 19. As shown in FIGS. 2 and 4, each of the jetting nozzles 20 (plurality of jetting ports (individual jetting ports) 20*a* of the jetting nozzles 20) overlaps with the end portion of each of the pressure chambers 14, the end portion being opposite to the manifold 17, and the jetting nozzles 20 are aligned in two rows, at a substantial central portion in the left and right direction of the ink-jet head 1, in the paper feeding direction (up and down direction in FIG. 2) at a pitch having equal intervals. When the nozzle plate 13 is made of a synthetic resin material or the like, the jetting nozzles 20 can be formed by excimer laser processing or the like. On the other hand, when the nozzle plate 13 is made of a metallic material, the jetting nozzles 20 can be formed by press processing or the like.

Figure 6:
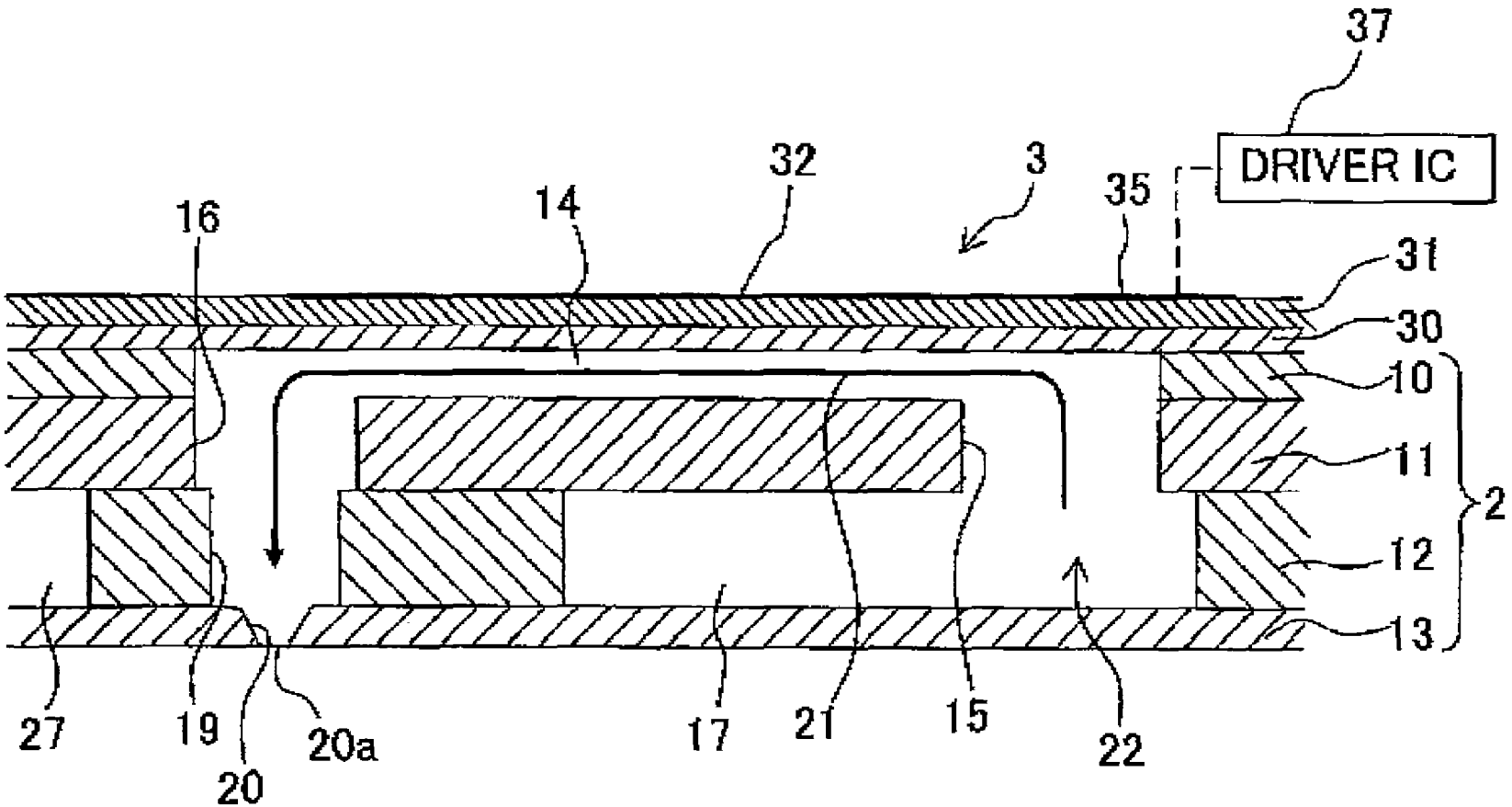
FIG. 6 is a cross-sectional view taken along a line VI-VI in FIG. 5.

As shown in FIG. 6, the manifold 17 communicates with each of the pressure chambers 14 via one of the communication holes 15, and each of the pressure chambers 14 communicates with one of the nozzles 20 via the communication holes 16, 19. In this way, a plurality of individual ink channels 21, each from the manifold 17 to one of the nozzles 20 via one of the pressure chambers 14, are formed in the channel unit 2. Further, the manifold 17 and the individual ink channels 21 construct a jetting channel 22 for jetting the ink from the jetting nozzles 20 onto the recording paper P.

In the ink-jet printer 100 of this embodiment, when any clog-up occurs in the jetting nozzles 20 and/or any air bubble enters in the jetting channel 22 in the channel unit 2, purge operation is performed by the cap 65 and the suction pump 66 to forcibly make the ink flow out (to be discharged) from the jetting nozzles 20. In addition, a maintenance mechanism 300 is provided in the channel unit 2 separately from the jetting channel 22 constructed of the manifold 17 and the individual ink channels 21 as described above. The maintenance mechanism 300 has recovery nozzles 25 and a recovery channel 28 for recovering (collecting) the ink flowed out from the jetting nozzles 20 during the purge operation.

Figure 7:
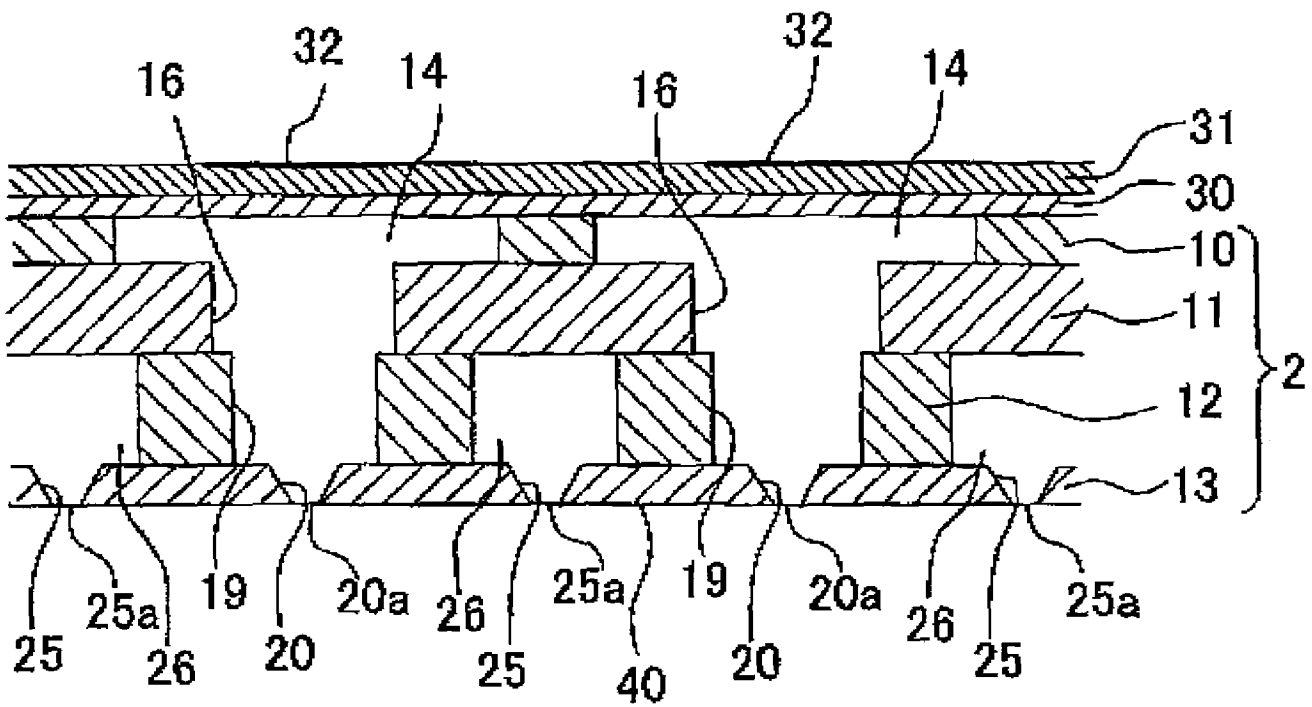
FIG. 7 is a cross-sectional view taken along a line VII-VII in FIG. 5.

As shown in FIGS. 2, 4 and 7, a plurality of recovery nozzles (individual recovery nozzles) 25 are formed in the nozzle plate 13 around the jetting nozzles 22 respectively. Recovery ports (individual recovery ports) 25*a*, which are openings of the recovery nozzles 25 in the ink-jetting surface 40, are arranged between the jetting ports 20*a* of the jetting nozzles 20 aligned in the paper feeding direction (up and down direction in FIGS. 2 and 4) such that the recovery ports 25*a* are adjacent to the jetting ports 20*a*. Similar to the jetting ports 20*a*, these recovery ports 25*a* are aligned in two rows in the paper feeding direction.

Further, in the channel unit 2, a recovery channel 28 communicating with the recovery nozzles 25 is formed. The recovery channel 28 is formed in the manifold plate 12 and includes a plurality of individual recovery channels 26 which communicate with the recovery nozzles 25 respectively and a merging channel 27 which is formed by merging the individual recovery channels 26. As shown in FIGS. 2 and 4, each of the individual recovery channels 26 extends in the scanning direction (left and right direction) from one of the recovery nozzles 25 aligned in two rows in a plan view, and merges to the merging channel 27, which extends in the paper feeding direction, at the central portion in the scanning direction (left and right direction in FIG. 2) of the channel unit 2. Further, the merging channel 27 is bent at one end thereof (upper end in FIGS. 2 and 4), and is connected, from a connecting port 29 formed in the cavity plate 10, to the sub tank 61 via a tube 63, the suction pump 66 and a tube 64.

During the purge operation, the cap 65 (as will be explained later) which receives jetted ink makes contact with the ink-jetting surface 40 of the ink-jet head 1, in which the jetting ports 20*a* of the jetting nozzles 20 are formed, such that the cap 65 covers the jetting ports 20*a*. In this state, the ink is forcibly flowed out from the jetting nozzles 20 by sucking air or the like on a side of the channel unit 28 and by depressurizing the space 50 (see FIG. 3) formed between the cap 65 and the ink-jetting surface 40 by the aid of the suction pump 66 (see FIG. 1). Mere, as shown in FIG. 4, since each of the recovery ports 25*a* is arranged between the jetting ports 20*a*, the recovery ports 25*a* are also covered by the cap 65. Further, the ink, flowed out from the jetting ports 20*a* of the jetting nozzles 20 into the space 50 formed between the cap 65 and the ink-jetting surface 40, is recovered to the sub tank 61, from the recovery nozzles 25 via the recovery channel 28.

Next, the piezoelectric actuator 3 will be explained. As shown in FIGS. 2 to 7, the piezoelectric actuator 3 includes a vibration plate 30 arranged on the upper surface of the channel unit 2; a piezoelectric layer 31 formed on the upper surface of the vibration plate 30; and a plurality of individual electrodes 32 formed on the upper surface of the piezoelectric layer 31 to correspond to the pressure chambers 14 respectively.

The vibration plate 30 is a plate made of a metallic material and has a substantially rectangular shape in a plan view, and made of, for example, an iron alloy such as stainless steel, a copper alloy, a nickel alloy, or a titanium alloy. The vibration plate 30 is provided to the upper surface of the cavity plate 10 so as to cover the pressure chambers 14, and is joined to the upper surface of the cavity plate 10. The metallic vibration plate 30 is electroconductive, and also serves as a common electrode which makes an electric field act in the piezoelectric layer 31 sandwiched between the vibration plate 30 and the individual electrodes 32.

Figure 3:
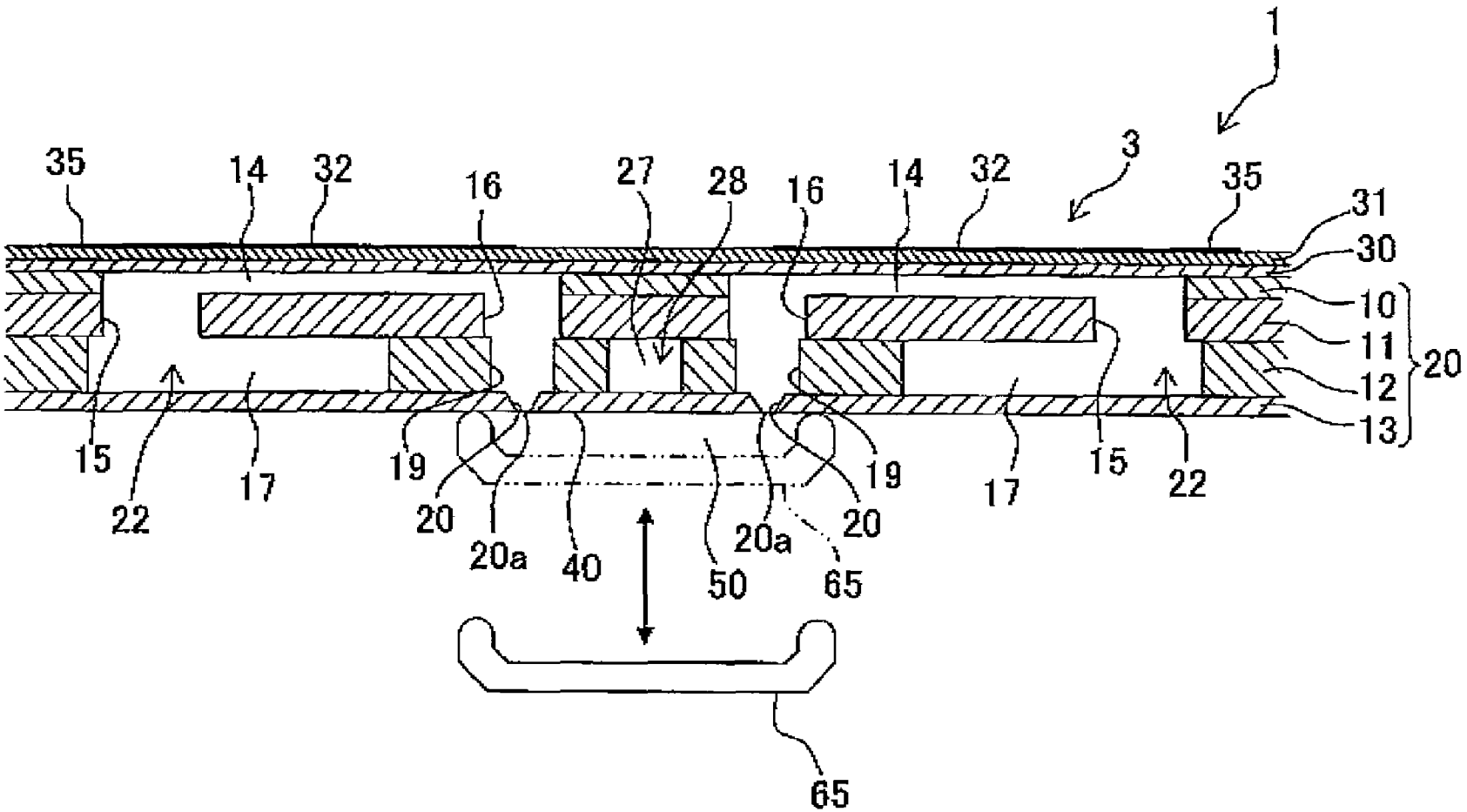
FIG. 3 is a cross-sectional view taken along a line III-III in FIG. 2.

The piezoelectric layer 31, which is mainly composed of lead zirconate titanate (PZT), which is a solid solution of lead titanate and lead zirconate and is a ferroelectric substance, is arranged on the upper surface of the vibration plate 30. As shown in FIGS. 2 and 3, the piezoelectric layer 31 is formed continuously over the pressure chambers 14. Here, the piezoelectric layer 31 can be formed by using an aerosol deposition method (AD method) in which very fine particles of a piezoelectric material are blown onto a substrate and collided to the substrate at high velocity, to be deposited onto the substrate. Alternatively, the piezoelectric layer 31 can be formed by a sputtering method, a chemical vapor deposition method (CVD method), a sol-gel method, a hydrothermal synthesis method, or the like. Still alternatively, the piezoelectric layer 31 may be formed by cutting a piezoelectric sheet made by baking a green sheet of PZT to a predetermined size, and by sticking the cut piezoelectric sheet or sheets to the vibration plate 30.

A plurality of individual electrodes 32 is formed in the upper surface of the piezoelectric layer 31. Each of the individual electrodes 32 has an elliptic shape in a plan view and is smaller in size to some extent than one of the pressure chambers 14. The individual electrodes 32 are formed at positions each of which overlaps in a plan view with a central portion of one of the pressure chambers 14 corresponding thereto. The individual electrodes 32 are made of a conductive material such as gold, copper, silver, palladium, platinum, or titanium. Further, the upper surface of the piezoelectric layer 31 is formed with a plurality of wirings-35 each of which extends parallel to the longitudinal direction (left and right direction in FIG. 2) of one of the individual electrodes 32, from an end of one of the individual electrodes 32 on a side of the manifold 17. These individual electrodes 32 and the wirings 35 can be formed by, for example, a screen printing, the sputtering method, a vapor deposition method or the like.

A wiring member having a flexibility (omitted in the drawings) such as a Flexible Printed Circuit (FPC) is connected to the wirings 35, and as shown in FIG. 6, the wirings 35 are connected to a driver IC 37 via the wiring member. Drive voltage is selectively applied to the individual electrodes 32 from the driver IC 37 via the wirings 35.

Next, the action of the piezoelectric actuator 3 will be explained. When drive voltage is selectively applied from the driver IC 37 to a desired individual electrode 32 of the individual electrodes 32, an electric potential of an individual electrode 32, which is disposed on the upper side of the piezoelectric layer 31 and to which the drive voltage is applied, is different from an electric potential of the vibration plate 30 which is disposed on the lower side of the piezoelectric layer 31 and which serves as a common electrode, and an electric field in a direction of thickness of the piezoelectric layer 31 is generated in a portion of the piezoelectric layer 31 sandwiched between the individual electrode 32 and the vibration plate 30. At this time, when the direction in which the piezoelectric layer 31 is polarized and the direction of the electric field are same, the piezoelectric layer 31 is contracted in a horizontal direction that is orthogonal to the thickness direction in which the piezoelectric layer 31 is polarized. At this time, since the vibration plate 30 is deformed to project toward the pressure chamber 14 accompanying with the contraction of the piezoelectric layer 31, the volume in the pressure chamber 14 is decreased to apply jetting pressure to the ink in the pressure chamber 14, thereby jetting the ink from a nozzle 20 communicating with the pressure chamber 14.

Next, the cap 65 and the suction pump 66 which are used during the purge operation will be explained. As shown in FIG. 1, the cap 65 is arranged outside (on left side in FIG. 1) of a carrying path for the recording paper P with respect to the scanning direction, at a position below a retract position of the ink-jet head 1. Further, as shown in FIG. 3, the cap 65 is moved in an up and down direction (direction indicated by a double-headed arrow in FIG. 3) by a drive motor (not shown). When the purge operation is performed, after the ink-jet head 1 is moved to the retract position, the cap 65 is drive upward to make contact with the ink-jetting surface 40.

As shown in FIGS. 3 and 4, the cap 65 has a shape long in the paper feeding direction in which the jetting nozzles 20 are aligned, and is capable of making contact with the central portion in the scanning direction (left and right direction in FIG. 4) of the ink-jetting surface 40, so as to cover all of the jetting ports 20*a* of the jetting nozzles 20 which are aligned in two rows. Here, as described above, the recovery ports 25*a* of the recovery nozzles 25 are each arranged between the jetting ports 20*a* which are aligned in the paper feeding direction (up and down direction in FIG. 4). Accordingly, when the cap 65 makes contact with the ink-jetting surface 40, all of the jetting ports 20*a* and the recovery ports 25*a* are covered by the cap 65 in a state that the jetting ports 20*a* and recovery ports 25*b* are sealed by the cap 65.

As shown in FIG. 1, the suction pump 66 is connected, via the tube 63, to the connecting port 29 (see FIGS. 2 and 4) which is an opening end of the recovery channel 28 formed in the channel unit 2. Further, the suction pump 66 is connected to the sub tank 61 via the tube 64. During the purge operation, as shown in FIGS. 3 and 4, the cap 65 makes contact with the ink-jetting surface 40, thereby sealing the jetting ports 20*a* of the jetting nozzles 20 and the recovery ports 25*a* of the recovery nozzles 25 and covering the jetting ports 20*a* and the recovery ports 25*a* by the cap 65. In this state, air or the like is sucked from the recovery channel 28 by the suction pump 66 via the tube 63, thereby depressurizing a space 50 between the cap 65 and the ink-jetting surface 40. Then, the ink is jetted from the jetting ports 20*a* of the jetting nozzles 20 to the inside of the space 50. Here, since the recovery ports 25*a* of the recovery nozzles 25 are arranged in the ink-jetting surface 40 to be adjacent to the jetting ports 20*a*, a flow of the ink from the jetting nozzles 20 to the recovery nozzles 25 (recovery channel 28) via the space 50 is generated, and a substantial portion of the ink, flowed out from the jetting nozzles 20 to the space 50, is sucked to the recovery ports 25*a* to be recovered to the recovery channel 28. Accordingly, an amount of the ink adhered to a portion in the vicinity of the jetting ports 20*a* in the ink-jetting surface 40 is small. Therefore, it is possible to prevent, as much as possible, the ink bubbled when being flowed out from the jetting nozzles 20 from returning to the inside of the channel unit 2 and from causing any jetting abnormality in the jetting nozzles 20 of the channel unit 2.

Figure 8:
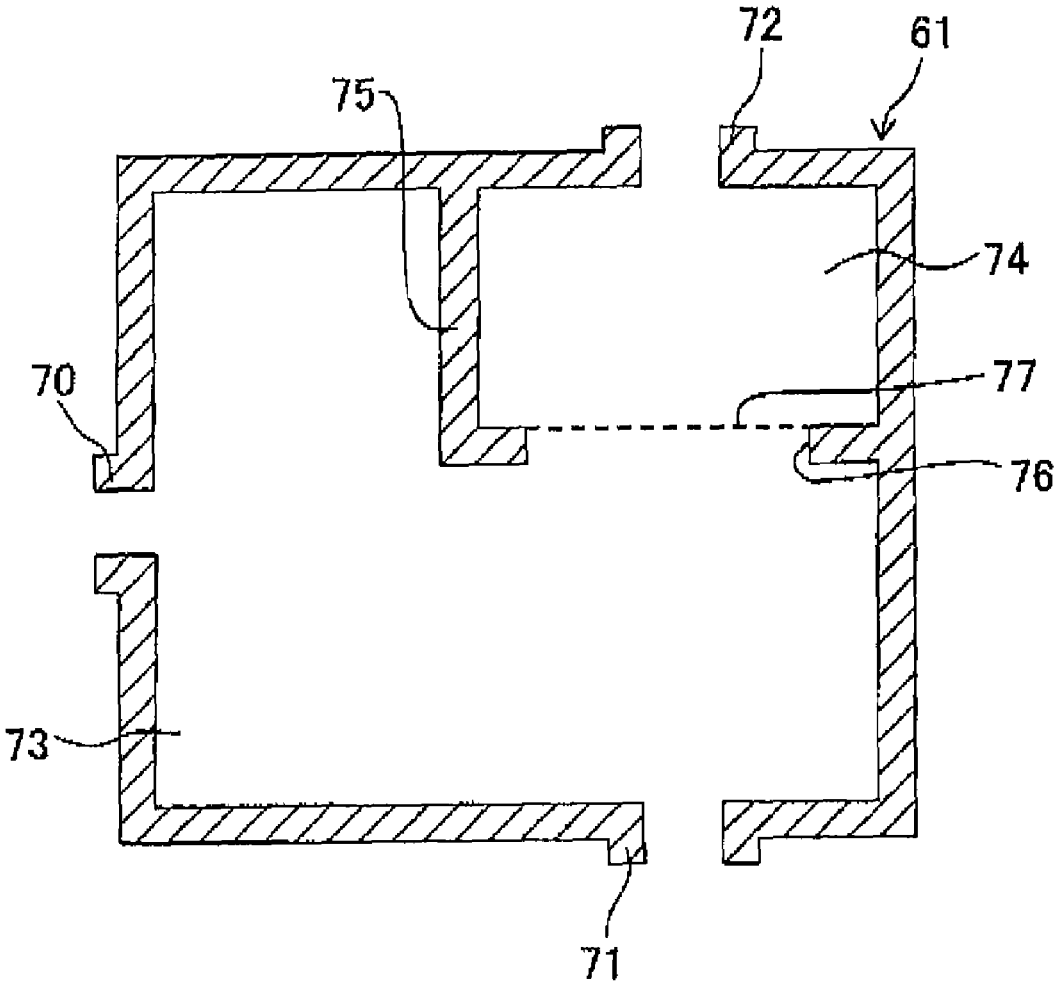
FIG. 8 is a cross-sectional view of a sub tank.

Further, the ink, sucked by the suction pump 66 from the recovery ports 25*a* to the recovery channel 28, is transported or fed to the sub tank 61 (storage portion) via the tube 64. As shown in FIG. 8, the sub tank 61 has: a tank connection portion 70 provided to a side portion of the sub tank 61 and connected to the ink tank 60 (see FIG. 1); an ink supply portion 71 provided in the bottom portion of the sub tank 61 and connected to the jetting channel 22 (ink supply port 18: see FIG. 2) of the channel unit 2; and an ink recovery portion 72 provided in the upper portion of the sub tank 61 and connected via the suction pump 66 to the recovery channel 28 (connection port 29: see FIG. 2) of the channel unit 2. Furthermore, the inside of the sub tank 61 are formed with an ink supply space 73 communicating with both of the tank connection portion 70 and the ink supply portion 71, and an ink recovery space 74 communicating with the ink recovery portion 72 and partitioned from the ink supply space 73 by a partition wall 75. The partition wall 75 is formed with a communication hole 76 communicating the ink supply space 73 and ink recovery space 74. Accordingly, the ink, which is recovered from the recovery ports 25*a* to the recovery channel 28 and which is flowed into the sub tank 61, is flowed from the ink recovery space 74 to the ink supply space 73 through the communication hole 76, and then is supplied again to the jetting channel 22 from the ink supply portion 71 to be reused (recycled). In addition, a filter 77 which removes a foreign substance, existing (contained) in the recovered ink recovered from the recovery channel 28, is provided to the communicating hole 76. Accordingly, the ink flowing to the inside of the sub tank 61 from the recovery channel 28 is subjected to removal of the foreign substance by the filter 77 in the sub tank 61, and after the foreign substance has been removed from the ink, the ink flows to the jetting channel 22. Accordingly, it is possible to prevent the foreign substance from flowing into the jetting channel 22 and causing the clog-up of the jetting nozzles 20. The sub tank 61 and tubes 62, 63, 64 correspond to the communication portion of the present invention, and communicate, in the outside of the channel unit 2, the jetting channel 22 and the recovery channel 28.

According to the ink-jet printer 100 as explained above, the following effects can be obtained. In the ink-jetting surface 40, the recovery ports 25*a* of the recovery nozzles 25 are provided adjacent to the jetting ports 20*a* of the jetting nozzles 20. During the purge operation, the jetting ports 20*a* of the jetting nozzles 20 and the recovery ports 25*a* of the recovery nozzles 25 are covered by one cap 65. Therefore, the substantial portion of the ink, which is sucked by the suction pump 66 from a side of the channel unit 28 and which flows out from the jetting nozzles 20, is recovered into the recovery channel 28 from the recovery ports 25*a* adjacent to the jetting ports 20*a*. Therefore, the ink bubbled upon flowing out from the jetting nozzles 20 is hardly adhered to the ink-jetting surface 40, and it is possible to prevent, as much as possible, the bubbled ink from returning to the inside of the channel unit 2 and from causing any jetting abnormality in the jetting nozzles 20.

Further, each of the recovery ports 25*a* is arranged between the jetting ports 20*a* aligned in the paper feeding direction. Accordingly, it is possible to recover the ink jetted from two jetting ports 20*a* by a recovery port 25*a* arranged between the two jetting ports 20*a*, thereby reducing the number of the recovery ports 25*a*. This makes it possible to arrange the recovery ports 25*a* effectively, and to miniaturize the ink-jet head 1 by arranging the jetting nozzles 20 highly densely.

Furthermore, the jetting channel 22 and the recovery channel 28 formed in the channel unit 2 are communicated with each other, in the outside of the channel unit 2, via the sub tank 61 and the tubes 62, 63, 64. Accordingly, it is possible to recover the liquid (ink) jetted from the jetting nozzles 20 during the purge operation, and then to return the recovered ink to the jetting channel 22 via the sub tank 61 and the tubes 62, 63, 64. Thus, the ink jetted during the purge operation can be reused. Accordingly, there is no need to provided, in the ink-jet printer 100, any wasted liquid chamber into which the ink recovered during the purge operation is discarded, thereby making it possible to reduce the number of parts of the ink-jet printer 100 to reduce the size thereof. In addition, since there is no need to estimate the amount of the ink which is to be discarded during the purge operation in advance, it is also possible to suppress the size of the ink tank 60. Further in the embodiment, the cap is not provided with any mechanism for sucking the ink. Therefore, is possible to make an area in which the printer body is installed to be smaller than in a case in which the cap and purge mechanism are constructed as an integrated body.

Next, modified embodiments in which various changes are made to the embodiment will be explained. Same reference numerals will be given to parts or components having similar construction as those in the embodiment, and explanation therefor will be omitted as appropriate.

First Modified Embodiment

Figure 9:
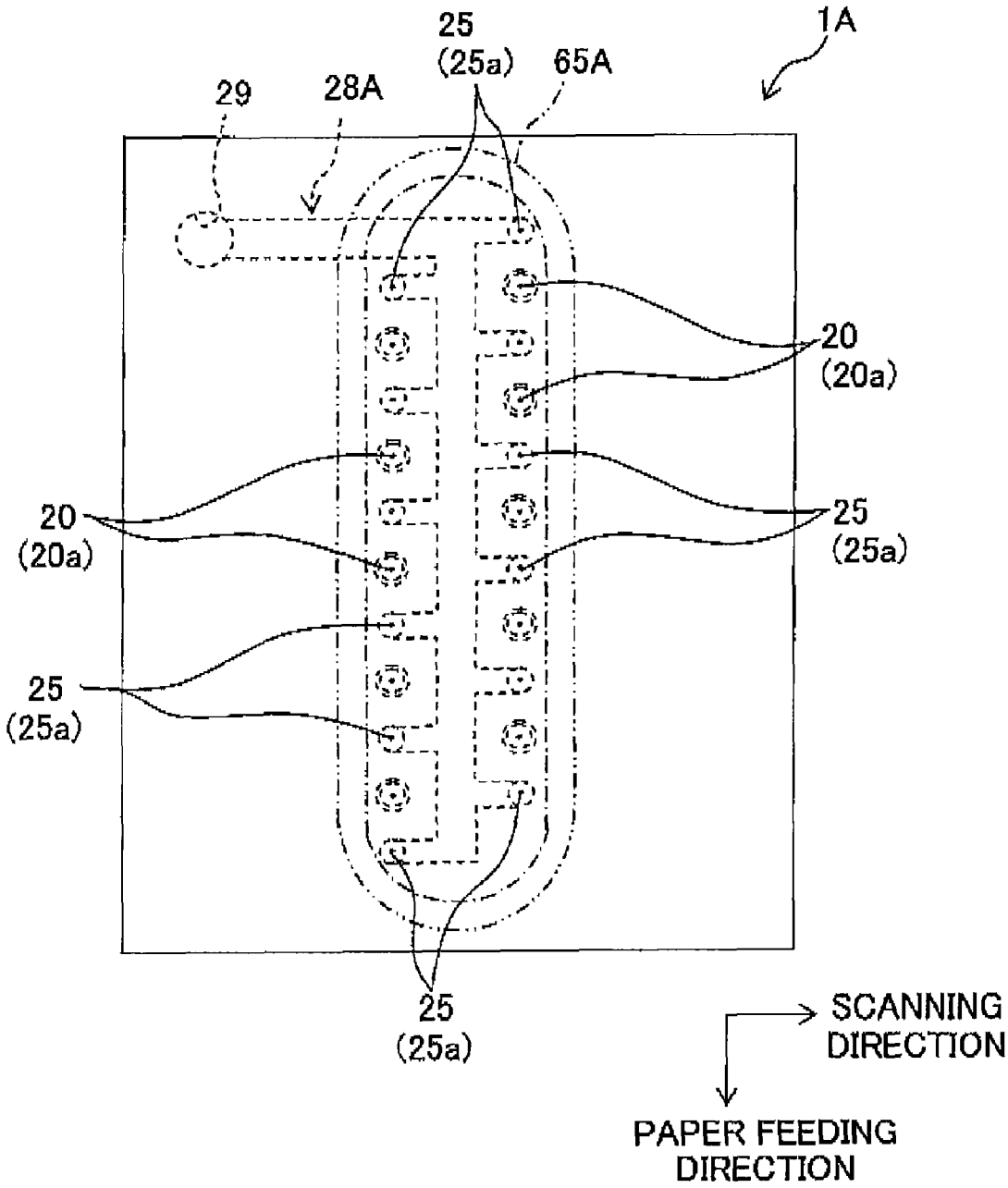
FIG. 9 is a bottom view of an ink-jet head of a first modified embodiment.

In an ink-jet head 1A, recovery ports 25*a* may be provided also to positions at both end positions (positions at both upper and lower end portions in FIG. 9) of the jetting ports 20*a* aligned in the paper feeding direction (up and down direction in FIG. 9); and two recovery ports 25*a* may be arranged for each of the jetting ports 20*a* at both end positions thereof (positions mutually opposite with respect to each of the jetting ports 20*a*). In this ink-jet head 1A, the ink, flowed out to a cap 65A from the jetting ports 20*a* during the purge operation, can be recovered by two recovery ports 25*a* located at both end sides, respectively, of each of the jetting ports 20*a*, the both end sides being in the direction in which the jetting ports 20*a* are aligned. Therefore, it is possible to further decrease an amount of the ink adhered to portions in the vicinity of the jetting ports 20*a*.

Second Modified Embodiment

Figure 10:
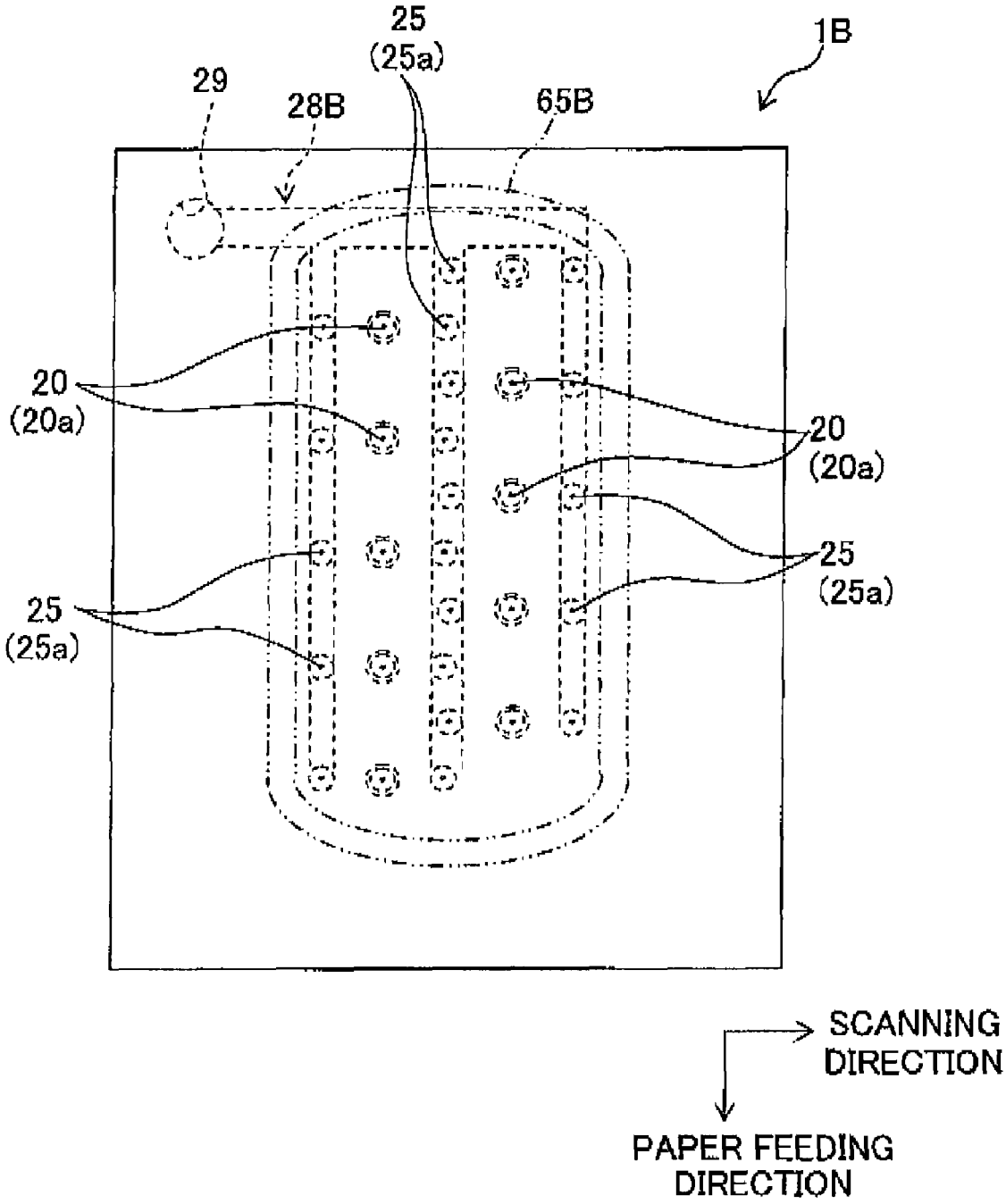
FIG. 10 is a bottom view of an ink-jet head of a second modified embodiment.

In an ink-jet head 1B, as shown in FIG. 10, a plurality of jetting ports 20*a* may be aligned in rows in the paper feeding direction (up and down direction in FIG. 10); a plurality of recovery ports 25*a* may be aligned in rows parallel to the rows of the jetting ports 20*a*, the rows of the recovery ports 25*a* being arranged at both sides, in the scanning direction (left and right direction in FIG. 10) of the rows of the jetting ports 20*a*; and two recovery ports 25*a*, included in the recovery ports 25*a*, may be arranged at positions in both sides, respectively, of each of the jetting ports 20*a*, the both sides being in the scanning direction (mutually opposite sides with respect to each of the jetting ports 20*a*). In this ink-jet head 1B also, the ink jetted from the jetting ports 20*a* to the cap 65B during the purge operation can be recovered to the recovery channel 28 from two recovery ports 25*a* located at both sides, respectively, of each of the jetting ports 20*a*, the both sides being in the scanning direction. Accordingly, an amount of the ink adhered to portions in the vicinity of the jetting ports 20*a* can be further decreased.

Third Modified Embodiment

A plurality of jetting ports 20*a* of jetting nozzles 20 may be aligned in a plurality of rows at a pitch of equal intervals; and a plurality of recovery ports 25*a* may be aligned between the rows of the jetting ports 20*a*. For example, in an ink-jet head 1C shown in FIG. 11, a plurality of recovery ports 20*a* of recovery nozzles 25 are aligned in a row between jetting ports 20*a* aligned in two rows, the row of the recovery ports 25*a* being parallel to the rows of the jetting ports 20*a*. In this construction, a wider area can be secured in the ink-jetting surface 40 in which the jetting nozzles 20 are arranged, as compared with the embodiment and the first and second modified embodiments as described above. Accordingly, it is possible to arrange the jetting nozzles 20 highly densely to miniaturize the ink-jet head 1C.

Figure 11:
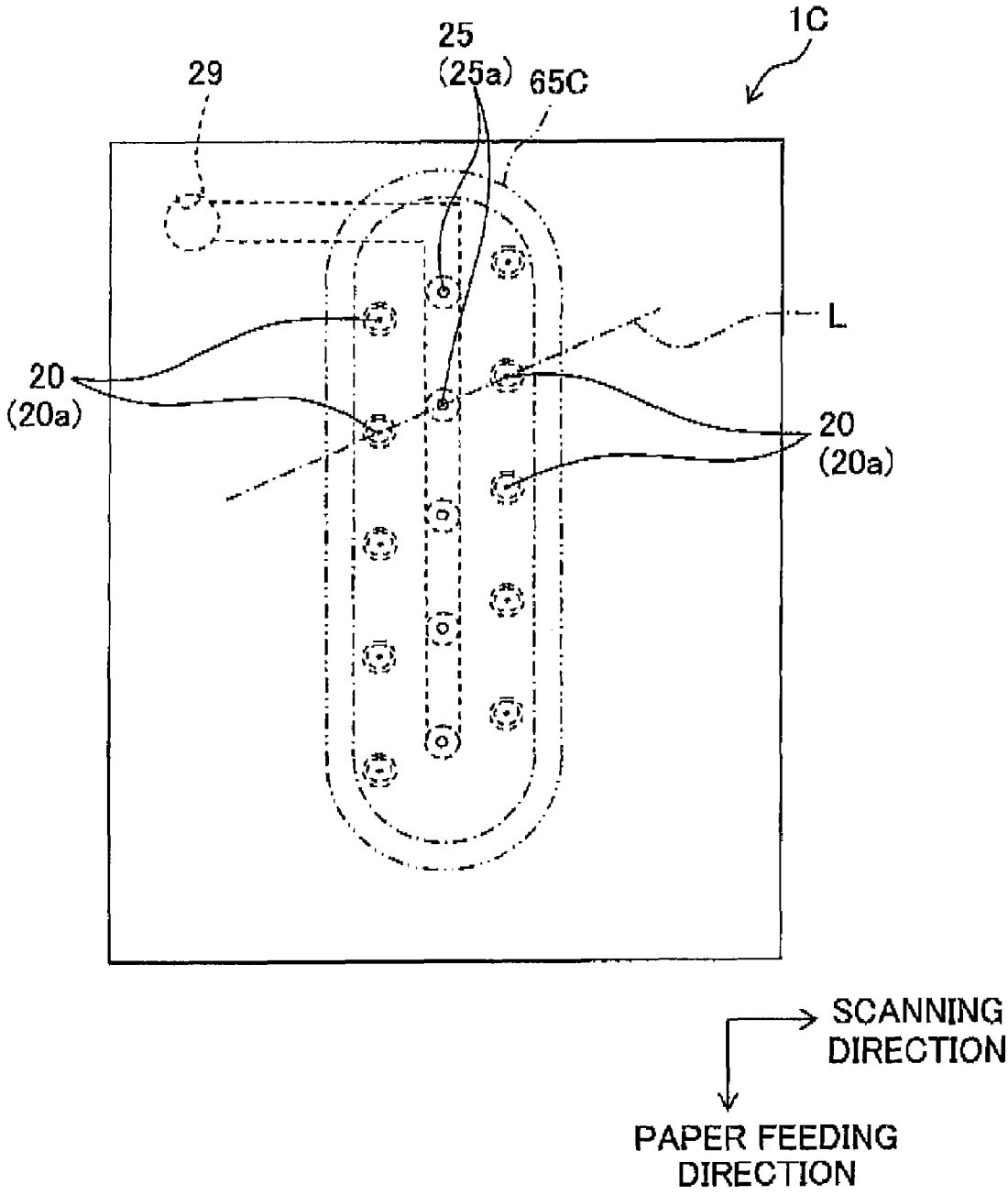
FIG. 11 is a bottom view of an ink-jet head of a third modified embodiment.

Further, in the ink-jet head 1C shown in FIG. 11, with respect to the two adjacent rows of the jetting ports 20*a*, a jetting port 20*a*, belonging to one of the two adjacent rows of the jetting ports 20*a*, is arranged to be shifted by a half of the pitch in the paper feeding direction (up and down direction in FIG. 11) relative to another jetting port 20*a* belonging to the other of the two adjacent rows. Furthermore, the recovery ports 25*a* are aligned at a pitch which is same as that at which the rows of the jetting ports 20*a* are aligned. Moreover, each of the recovery ports 25*a* is located at a position in a line L connecting two jetting ports 20*a* included in the two rows of individual jetting ports 20*a*, respectively, and which are arranged to be shifted from each other by the half of the pitch in the paper feeding direction that is an alignment direction of the rows, the two rows of the individual jetting ports 20*a* being aligned on both sides, respectively, of the individual recovery ports 25*a*. Each of the recover ports 25*a* is located in the line L in the position such that the distance between each of the recovery ports 25*a* and any one of the two jetting ports 20*a* is equal (each of the recovery ports 25*a* is equidistant from the two jetting ports 20*a*). In this ink-jet head 1C, it is possible to efficiently recover the ink jetted from the jetting nozzles 20 to the cap 65C during the purge operation with the recovery nozzles 25 which number is small (half the number of the jetting nozzles 20). In this construction, however, since the number of the recovery ports 25*a* (recovery nozzles 25) are smaller than that in the above-mentioned embodiment, an overall amount of the recovered ink is also small as compared to the embodiment. Accordingly, in order to recover larger amount of the ink with smaller number of the recovery ports 25*a*, the diameter of recovery ports 25*a* may be larger than that of the jetting ports 25*a* as shown in FIG. 11, for example.

Forth Modified Embodiment

Figure 12:
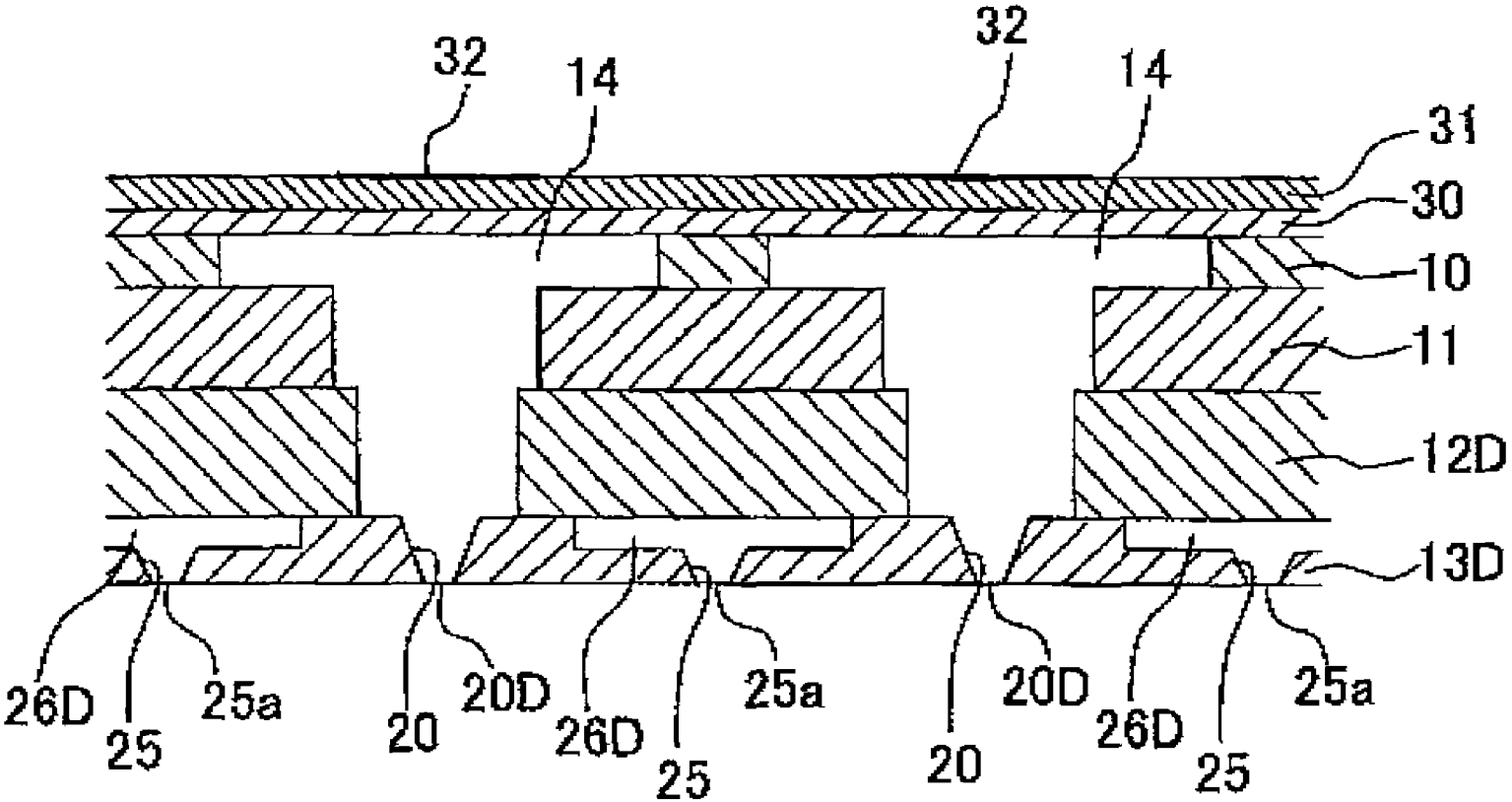
FIG. 12 is a cross-sectional view of a fourth modified embodiment, corresponding to FIG. 7.

As shown in FIG. 12, individual recovery channels 26D communicating with recovery nozzles 25, respectively, may be formed in a nozzle plate 13D rather than in a manifold plate 12D.

Fifth Modified Embodiment

Figure 13:
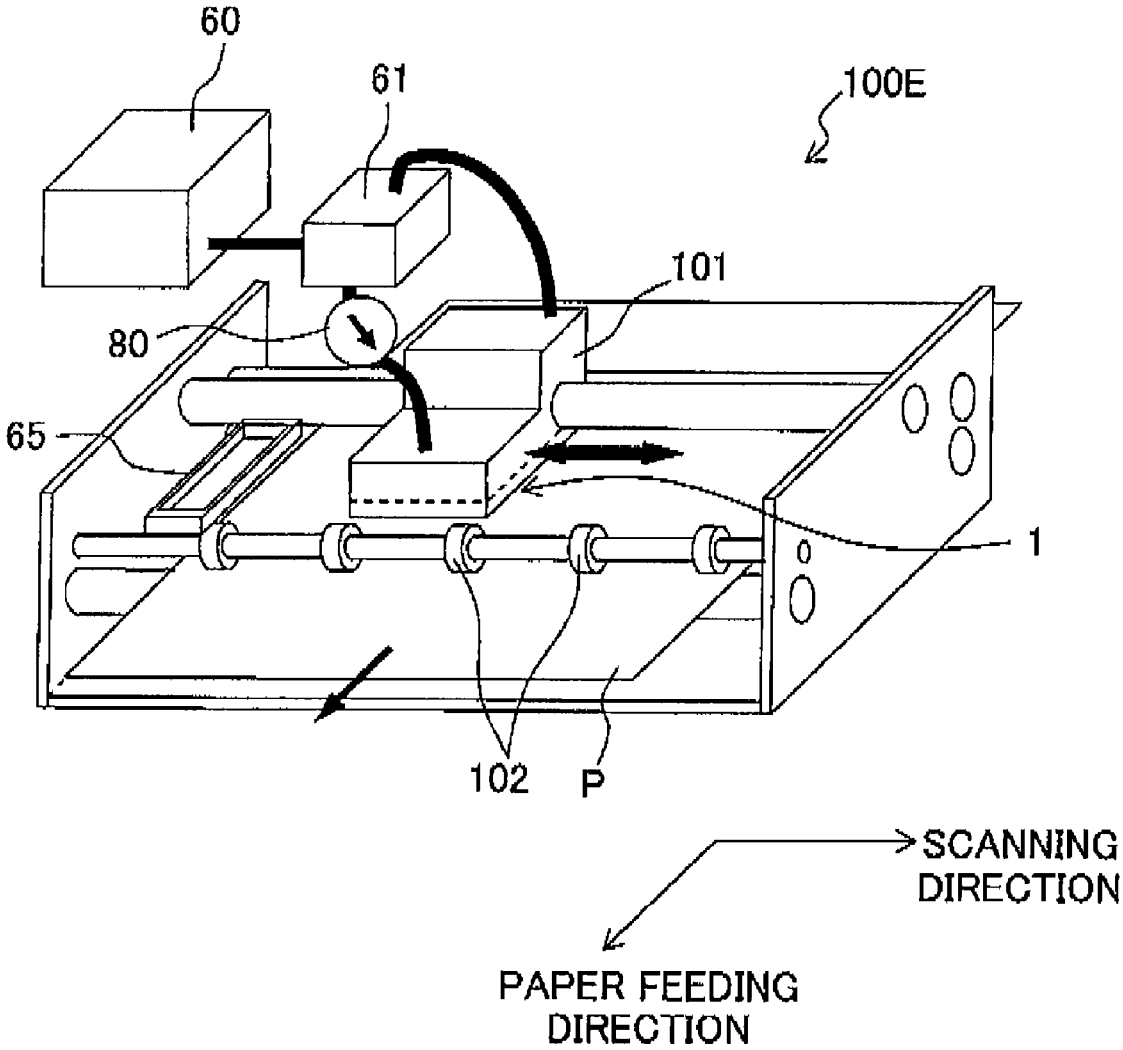
FIG. 13 is a schematic view showing a structure of an ink-jet printer of a fifth modified embodiment.

As in an ink-jet printer 100E shown in FIG. 13, instead of the suction pump 66 (see FIG. 1) of the above-mentioned embodiment, a pressurizing pump 80 (pressurizing unit) which pressurizes ink in the jetting channel 22 during the purge operation to make the ink flow out from the jetting nozzles 20 may be provided between the sub tank 61 and the jetting channel 22 of the ink-jet head 1 (channel unit 2). In this case also, it is possible to apply purge pressure for ink recovery to the ink in the recovery channel 28 which is in fluid communication with the jetting channel 22.

Sixth Modified Embodiment

Figure 14:
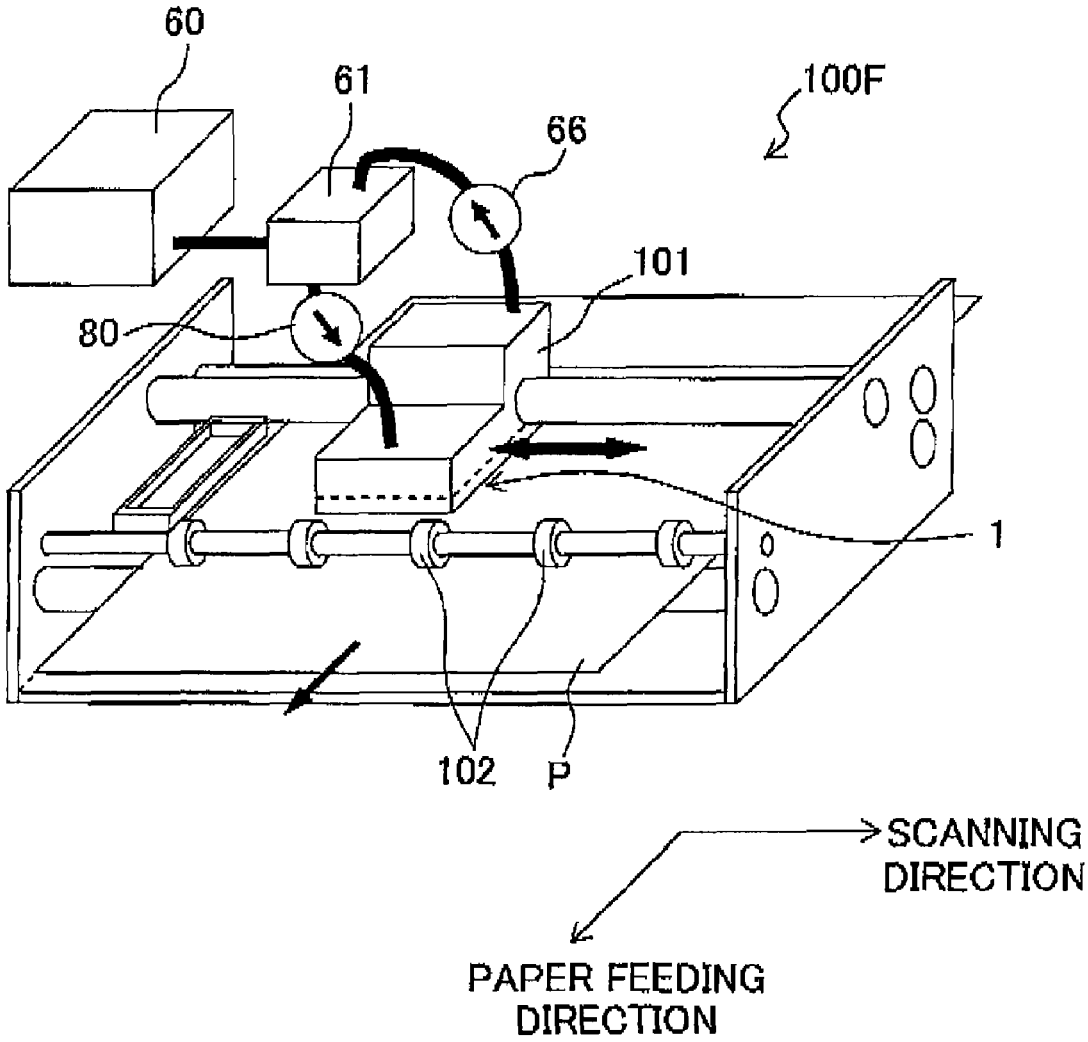
FIG. 14 is a schematic view showing a structure of an ink-jet printer of a sixth modified embodiment.

Further, as in an ink-jet printer 100F shown in FIG. 14, a suction pump 66 may be provided between the sub tank 61 and the recovery channel 28 of the ink-jet head 1 (channel unit 2), and a pressurizing pump 80 may be provided between the sub tank 61 and the jetting channel 22. According to this construction, during the purge operation, the suction pump 66 performs sucking on a side of the recovery channel 28, and the pressurizing pump 80 pressurizes the ink on a side of the jetting channel 22 to jet the ink from the jetting nozzles 20. Accordingly, it is possible to further increase the jetting speed and to purge the jetting nozzles 20 more assuredly.

The purge operation may be performed by using a mechanism (piezoelectric actuator 3) which applies pressure to the ink in the jetting channel 22, rather than providing a dedicated pump. In this case, it is desirable to control the mechanism which applies the pressure to the ink such that the pressure applied to the ink during the purging operation is greater than the pressure applied to the ink during the recording operation. In this case also, it is possible to apply purge pressure for ink recovery to the ink in the recovery channel 28 which is in fluid communication with the jetting channel 22.

The mechanism which applies pressure to the ink in the jetting channel is not limited to the piezoelectric actuator. The mechanism may be, for example, a mechanism which heats the ink and brings the ink to boiling by a heater to apply pressure to the ink, or a mechanism which deforms an actuator in the form of a thin-plate by a static electricity to apply pressure to the ink.

Seventh Modified Embodiment

Figure 15A:
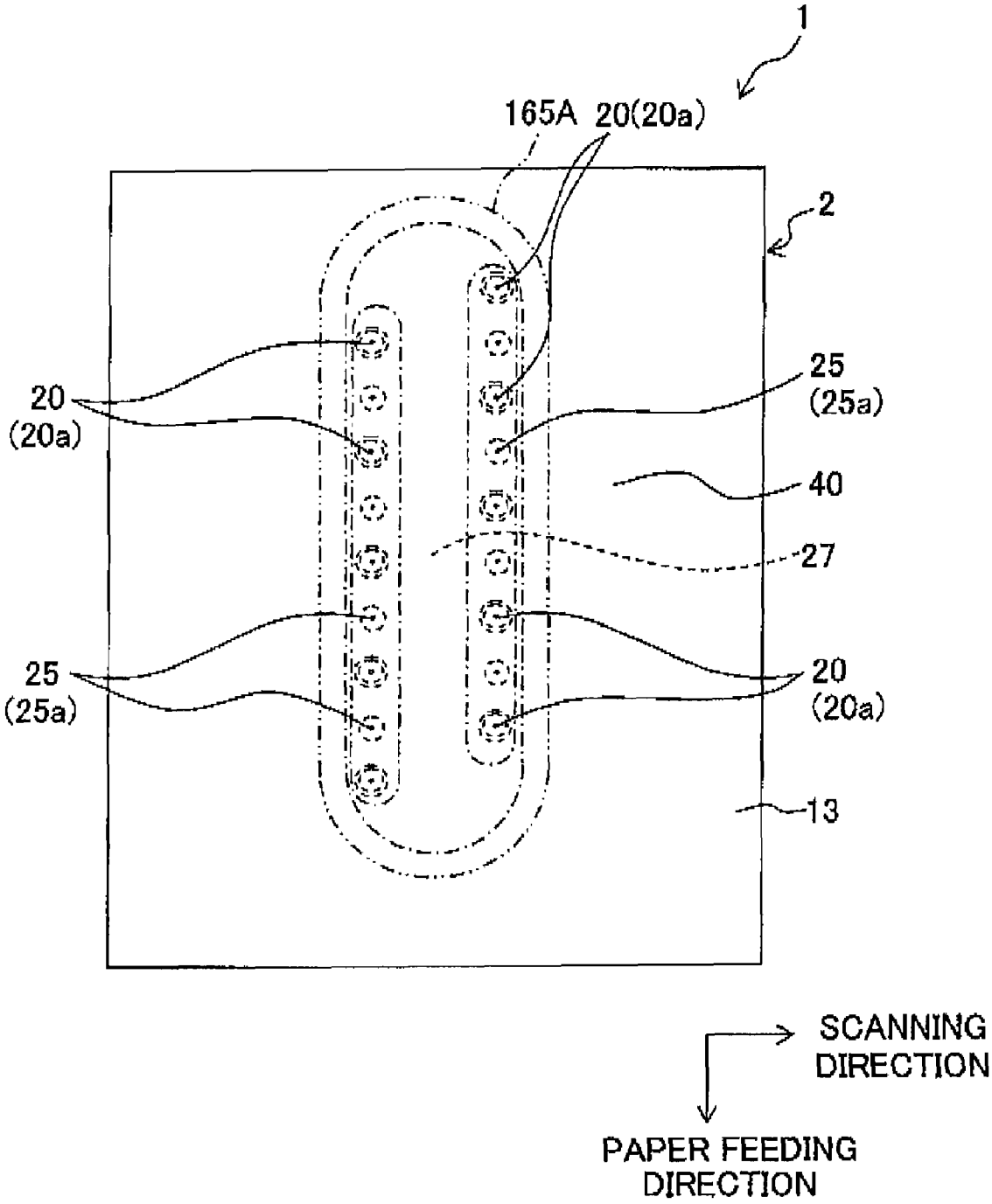
FIGS. 15A, 15B are a bottom view of an ink-jet head of a seventh modified embodiment.
Figure 15B:
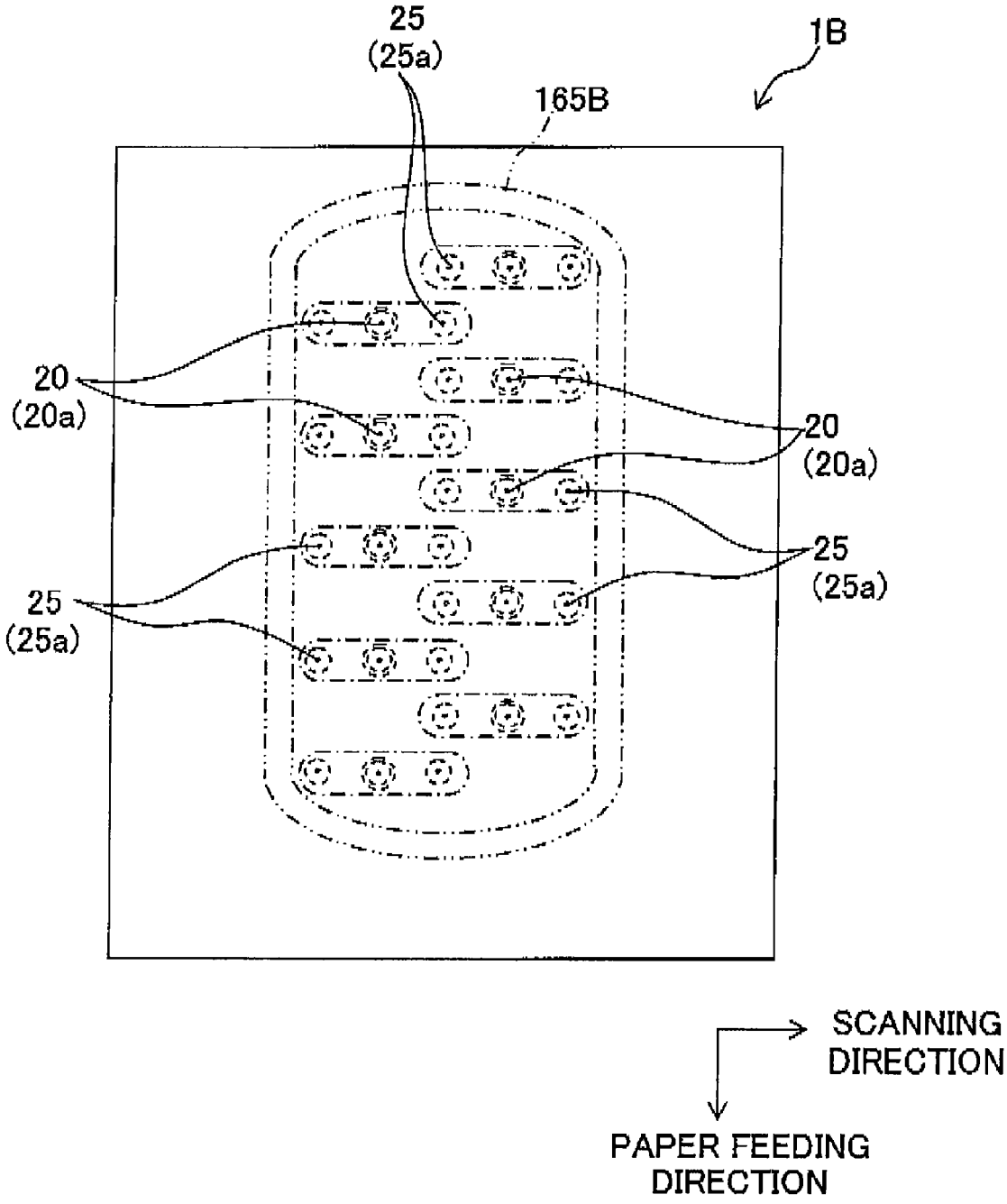

The shape of the cap which covers the ink-jetting surface of the ink-jet head during the purge operation is not limited to the shape shown in the above-mentioned embodiment and the modified embodiments, and may be take arbitrary shape. The inner shape of the cap, in particular, may be changed arbitrarily in accordance with the arrangement of the jetting nozzles 20 and the recovery nozzles 25. For example, as shown in the embodiment, it is possible to use a cap of which inner portion is not partitioned. In this case, when the cap covers the ink-jetting surface, one continuous space is formed by the inner surface of the cap and the ink-jetting surface. Alternatively, a cap 165A as shown in FIG. 15A can be used, for example, in the ink-jet head 1 as explained with reference to FIG. 4 and provided with the jetting nozzles 20 and recovery nozzles 25 aligned in rows. The inner portion of the cap 165A is partitioned for each of the nozzle rows. In this case, during the purge operation, the ink is not scattered in a portion between the nozzle rows. In addition, since a volume of the space to be sucked by one of the recovery nozzles becomes small, it is possible to improve the suction efficiency of the recovery nozzles. Still alternatively, a cap 165B as shown in FIG. 15B can be used, for example, in an ink-jet head 1B as explained with reference to FIG. 10 and provided with the jetting nozzles 20 aligned in rows and the recovery nozzles 25 aligned in rows, the rows of the recovery nozzles 25*a* being arranged at both sides of each of the rows of the jetting nozzles 20. The inner portion of the cap 165B is partitioned into ten pieces of areas each of which includes one jetting nozzle 20 and recovery nozzles 25 at the both sides of the jetting nozzle 20 as a unit. In this case also, there is no fear that the ink is scattered beyond the areas during purge operation. In addition, since a volume of the space to be sucked per one recovery nozzle becomes very small, it is possible to improve the efficiency of the suction. In FIGS. 15A, 15B, the recovery channel is omitted.

Eighth Modified Embodiment

Figure 16:
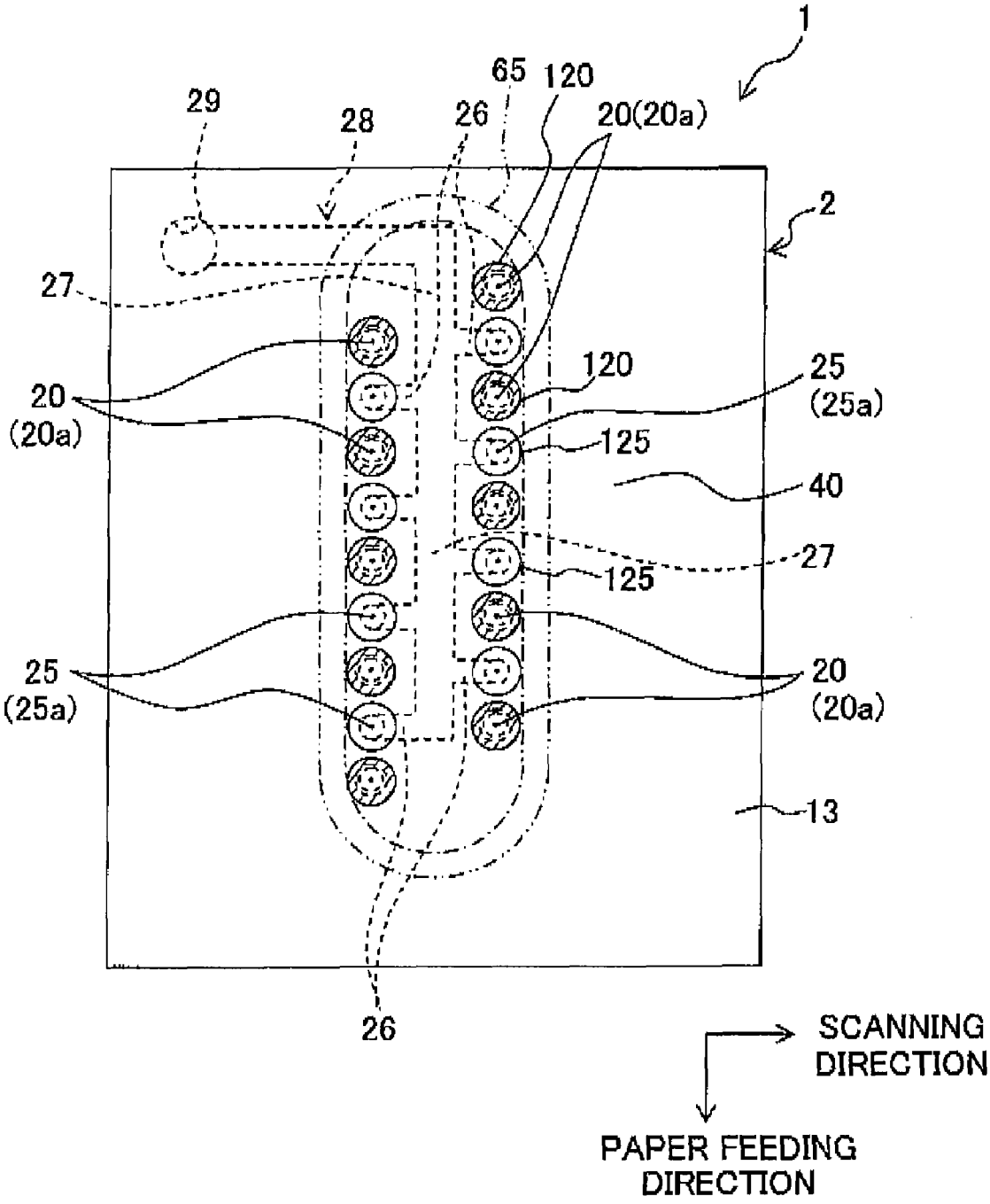
FIG. 16 is a bottom view of an ink-jet head of an eighth modified embodiment.

The degree of liquid repellence of the ink-jetting surface of the ink-jet head can be arbitrarily adjusted. For example, as shown in FIG. 16, it is possible to form high liquid-repellence areas 120 around the jetting nozzles 20 respectively, and to form low liquid-repellence areas 125 around the recovery nozzles 25, respectively. In this manner, by forming the high liquid-repellence areas 120 around the jetting nozzles 20, it is possible to prevent the ink from adhering around the jetting nozzles 20. Further, by forming the low liquid-repellence areas 125 around the recovery nozzles 25, it is possible to effectively recover the ink adhered to portions around the recovery nozzles 25. The high liquid-repellent areas 120 formed around the jetting nozzles 20 may be formed by, for example, coating a film made of fluorine-based resin. The low liquid-repellent areas 125 formed around the recovery nozzles 25 may be formed by, for example, coating a hydrophilic film. Alternatively, when the nozzle plate 13 is formed of a material such as polyimide, the low liquid-repellent areas 125 may also be formed by irradiating a low-power laser beam onto a surface of the nozzle plate 13 to lower the liquid repellence of areas, in the nozzle plate 13, irradiated with the laser beam. Further, only any one of the high liquid-repellent areas and the low liquid-repellent areas may be formed on the ink-jetting surface of the nozzle plate 13. In such a case also, it is possible to obtain the above effect.

The foregoing explanation is about the embodiment and its modified embodiments in which the present invention is applied to an ink-jet printer, as a liquid-droplet jetting apparatus, which jets an ink onto a recording paper to perform recording. However, an embodiment to which the present invention is applicable is not limited to the embodiment and its modified embodiments, and the present invention can be applied to various types of liquid-droplet jetting apparatuses which jet liquid, other than ink, to various types of objects.

What is claimed is:

1. A liquid-droplet jetting apparatus which jets a liquid in a liquid-droplet state, the liquid-droplet jetting apparatus comprising:

a channel unit comprising:

a jetting nozzle comprising a plurality of individual jetting nozzles;

a jetting channel communicating with the jetting nozzle;

a recovery nozzle comprising a plurality of individual recovery nozzles;

a recovery channel communicating with the recovery nozzle;

and a liquid-droplet jetting surface in which a plurality of individual jetting ports and a plurality of individual recovery ports are formed adjacently as openings of the plurality of individual jetting nozzles and openings of the plurality of individual recovery nozzles, respectively;

a jetting-pressure applying mechanism which applies jetting pressure to the liquid in the jetting channel;

a cap which detachably covers both of the jetting port of the jetting nozzle and the recovery port of the recovery nozzle; and a purge pressure applying mechanism which causes the liquid in the jetting channel to flow to the recovery channel when the cap covers both of the jetting port and the recovery port;

wherein the liquid is flowed out from the jetting port to be recovered from the recovery port to the recovery channel by the purge pressure applying mechanism;

wherein the individual jetting ports are aligned in a predetermined direction in the liquid-droplet jetting surface; and each of the individual recovery ports is arranged aligned in a row and between the individual jetting ports.

2. The liquid-droplet jetting apparatus according to claim 1, wherein the cap is partitioned into a plurality of areas, and each of the areas of the cap independently covers the individual jetting ports and the individual recovery ports.

3. The liquid-droplet jetting apparatus according to claim 1, wherein:

the individual jetting ports are aligned in two rows which are adjacent to each other and which extend in the predetermined direction;

the individual recovery ports are aligned in the two rows together with the jetting ports, respectively; and the recovery channel comprises a merging channel formed between the two rows and extending in the predetermined direction and a plurality of individual recovery channels, each of which connects the merging channel and one of the recovery ports.

4. A liquid-droplet jetting apparatus which jets a liquid in a liquid-droplet state, the liquid-droplet jetting apparatus comprising:

a channel unit comprising:

a jetting nozzle comprising a plurality of individual jetting nozzles;

a jetting channel communicating with the jetting nozzle;

a recovery nozzle comprising a plurality of individual recovery nozzles;

a recovery channel communicating with the recovery nozzle;

and a liquid-droplet jetting surface in which a plurality of individual jetting ports and a plurality of individual recovery ports are formed adjacently as openings of the plurality of individual jetting nozzles and openings of the plurality of individual recovery nozzles, respectively;

a jetting-pressure applying mechanism which applies jetting pressure to the liquid in the jetting channel;

a cap which detachably covers both of the jetting port of the jetting nozzle and the recovery port of the recovery nozzle; and a purge pressure applying mechanism which causes the liquid in the jetting channel to flow to the recovery channel when the cap covers both of the jetting port and the recovery port;

wherein the liquid is flowed out from the jetting port to be recovered from the recovery port to the recovery channel by the purge pressure applying mechanism;

wherein the individual jetting ports are aligned in a row in a predetermined direction in the liquid-droplet jetting surface; and wherein the individual recovery ports are aligned in rows parallel to the predetermined direction in which the individual jetting ports are aligned, the rows of the individual recovery ports being at both sides of the row of the individual jetting ports.

5. The liquid-droplet jetting apparatus according to claim 4, wherein the cap is partitioned into a plurality of areas, and each of the areas of the cap independently covers the individual jetting ports and the individual recovery ports.

6. A liquid-droplet jetting apparatus which jets a liquid in a liquid-droplet state, the liquid-droplet jetting apparatus comprising:

a channel unit comprising:

a jetting nozzle comprising a plurality of individual jetting nozzles;

a jetting channel communicating with the jetting nozzle;

a recovery nozzle comprising a plurality of individual recovery nozzles;

a recovery channel communicating with the recovery nozzle;

and a liquid-droplet jetting surface in which a plurality of individual jetting ports and a plurality of individual recovery ports are formed adjacently as openings of the plurality of individual jetting nozzles and openings of the plurality of individual recovery nozzles, respectively;

a jetting-pressure applying mechanism which applies jetting pressure to the liquid in the jetting channel;

a cap which detachably covers both of the jetting port of the jetting nozzle and the recovery port of the recovery nozzle; and a purge pressure applying mechanism which causes the liquid in the jetting channel to flow to the recovery channel when the cap covers both of the jetting port and the recovery port;

wherein the liquid is flowed out from the jetting port to be recovered from the recovery port to the recovery channel by the purge pressure applying mechanism;

wherein the individual jetting ports are aligned in a plurality of rows along a predetermined direction and at a predetermined pitch in the liquid-droplet jetting surface;

wherein an individual jetting port, belonging to one of two adjacent rows included in the rows of the individual jetting ports, is arranged in the predetermined direction to be shifted by a half of the pitch relative to another individual jetting port belonging to the other of the two adjacent rows of the individual jetting ports;

wherein the individual recovery ports are aligned, between the two adjacent rows of the individual jetting ports, along the predetermined direction and at the predetermined pitch; and wherein each of the individual recovery ports is positioned on a line connecting two individual jetting ports belonging to the two rows of the individual jetting ports, respectively, and which are arranged in the predetermined direction to be shifted from each other by the half of the pitch, the two rows of the individual jetting ports being aligned on both sides, respectively, of the individual recovery ports.

7. The liquid-droplet jetting apparatus according to claim 6, wherein the cap is partitioned into a plurality of areas, and each of the areas of the cap independently covers the individual jetting ports and the individual recovery ports.

8. A liquid-droplet jetting apparatus which jets a liquid in a liquid-droplet state, the liquid-droplet jetting apparatus comprising:

a channel unit comprising:

ajetting nozzle;

a jetting channel communicating with the jetting nozzle;

a recovery nozzle;

a recovery channel communicating with the recovery nozzle;

and a liquid-droplet jetting surface in which a jetting port and a recovery port are formed as an opening of the jetting nozzle and an opening of the recovery nozzle, respectively;

a jetting-pressure applying mechanism which applies jetting pressure to the liquid in the jetting channel;

a cap which detachably covers both of the jetting port of the jetting nozzle and the recovery port of the recovery nozzle; and a purge pressure applying mechanism which causes the liquid in the jetting channel to flow to the recovery channel when the cap covers both of the jetting port and the recovery port;

wherein the liquid is flowed out from the jetting port to be recovered from the recovery port to the recovery channel by the purge pressure applying mechanism;

wherein the recovery port of the recovery nozzle is formed in the liquid-droplet letting surface, adjacent to the jetting port of the jetting nozzle; and a communication section which communicates the jetting channel and the recovery channel in an outside of the channel unit.

9. The liquid-droplet jetting apparatus according to claim 8, wherein the communication section is provided with a filter which removes a foreign substance existing in the liquid recovered from the recovery channel.

10. The liquid-droplet jetting apparatus according to claim 9, wherein the communication section has a storage portion which stores the liquid recovered from the recovery channel; and the filter is provided in the storage portion.

11. The liquid-droplet jetting apparatus according to claim 8, wherein the liquid recovered from the recovery channel is jetted from the jetting nozzle via the jetting channel.

12. The liquid-droplet jetting apparatus according to claim 8, wherein the purge pressure applying mechanism includes a suction unit which performs sucking from a side of the recovery channel to depressurize a space formed between the cap and the liquid-droplet jetting surface.

13. The liquid-droplet jetting apparatus according to claim 8, wherein the purge pressure applying mechanism further includes a pressurizing unit which pressurizes the liquid in the jetting channel.

14. The liquid-droplet jetting apparatus according to claim 8, wherein:

the recovery nozzle and the recovery channel are formed as a maintenance mechanism which performs maintenance for the channel unit; and the purge pressure applying mechanism is fluidly connected to the recovery channel and applies purge pressure to the liquid in the recovery channel.

15. A liquid-droplet jetting apparatus which jets a liquid in a liquid-droplet state, the liquid-droplet jetting apparatus comprising:

a channel unit comprising:

a jetting nozzle a jetting channel communicating with the jetting nozzle;

a recovery nozzle comprising a plurality of individual recovery nozzles;

a recovery channel communicating with the recovery nozzle;

and a liquid-droplet jetting surface in which a jetting port and a recovery port are formed as an opening of the jetting nozzle and an opening of the recovery nozzle, respectively;

a jetting-pressure applying mechanism which applies jetting pressure to the liquid in the jetting channel;

a cap which detachably covers both of the jetting port of the jetting nozzle and the recovery port of the recovery nozzle; and a purge pressure applying mechanism which causes the liquid in the jetting channel to flow to the recovery channel when the cap covers both of the jetting port and the recovery port;

wherein the liquid is flowed out from the jetting port to be recovered from the recovery port to the recovery channel by the purge pressure applying mechanism; and wherein liquid repellence of an area around the jetting port is greater than that of an area around the recovery port in the liquid-droplet jetting surface.

* * * * *

UNITED STATES PATENT AND TRADEMARK OFFICE

CERTIFICATE OF CORRECTION

PATENT NO. : 7,537,307 B2
APPLICATION NO. : 11/420843
DATED : May 26, 2009
INVENTOR(S) : Hiroto Sugahara It is certified that error appears in the above-identified patent and that said Letters Patent is hereby corrected as shown below:

Claim 15, Column 18, Lines 38-39, delete the phrase: "comprising a plurality of individual recovery nozzles" after the words: "a recovery nozzle"

Signed and Sealed this

Eighth Day of September, 2009

David J. Kappos

David J. Kappos
*Director of the United States Patent and Trademark Office*